US005813238A

United States Patent [19]

Lee

[11] Patent Number: 5,813,238

[45] Date of Patent: Sep. 29, 1998

[54] AUTOMATIC ICE PRODUCTION APPARATUS

[75] Inventor: Kun Bin Lee, Seoul, Rep. of Korea

[73] Assignee: Samsung Electronics Co., Ltd., Suwon, Rep. of Korea

[21] Appl. No.: 936,628

[22] Filed: Sep. 24, 1997

Related U.S. Application Data

[62] Division of Ser. No. 726,791, Oct. 7, 1996.

[51] Int. Cl.[6] ..... F25C 5/06

[52] U.S. Cl. ..... 62/71; 62/126

[58] Field of Search ..... 62/126, 129, 71, 62/353, 389

[56] References Cited

U.S. PATENT DOCUMENTS

| | | | |
|---|---|---|---|
| 4,456,149 | 6/1984 | Sciortino | 222/1 |
| 4,774,814 | 10/1988 | Yingst et al. | 62/126 |
| 4,909,039 | 3/1990 | Yamada et al. | 62/66 |
| 4,941,806 | 7/1990 | Brown et al. | 417/38 |
| 5,035,118 | 7/1991 | Hara | 62/126 |
| 5,527,470 | 6/1996 | Suda | 62/126 |

*Primary Examiner*—William E. Tapolcai
*Attorney, Agent, or Firm*—Burns, Doane, Swecker & Mathis, L.L.P.

[57] ABSTRACT

An automatic ice production apparatus and a method thereof, comprising an ice removing motor rotation control function, an ice removing motor protection function, a water supply alarm/indication function, a water supply state control function and a water supply motor control function. To perform the above functions, the automatic ice production apparatus comprises an ice removing motor rotation controller for controlling a rotating operation of an ice removing motor, a water supply motor rotation controller for controlling operation of a water supply motor, a water supply state controller for controlling the supply of the water pumped by the water supply motor to the automatic ice production apparatus and a dispenser, a water level detector for detecting the level of water in a water supply tank, an alarm generator for generating an alarm in response to the water level detected by the water level detector, and a microcomputer for controlling the entire operation of the automatic ice production apparatus.

9 Claims, 17 Drawing Sheets

AUTOMATIC ICE PRODUCTION APPARATUS

This application is a divisional of application Ser. No. 08/726,791, filed Oct. 7, 1996.

BACKGROUND OF THE INVENTION

1. Field of the Invention

The present invention relates to an apparatus and method for automatic ice production and more particularly, to an automatic ice production apparatus and a method for preventing a tray from being distorted by alternatively performing a normal/reverse rotating operation of the tray when an ice producing operation has been completed, and then an ice removing operation is performed to remove the ice from the tray.

2. Description of the Prior Art

Generally, automatic ice production involves a process wherein water is automatically supplied to a tray and then is checked to determine if an ice producing operation has been completed, and if it is determined that an ice producing operation has been completed, ice produced thereby is automatically removed from the tray and then stored in an ice container within a freezer compartment of a refrigerator. Hence, ice production can be very conveniently performed without involvement of a user. In this connection, recently, an automatic ice production feature has been found desirable in a refrigerator offered together with a dispenser for allowing a user to obtain drinking water without opening the door of the refrigerator. Such a conventional automatic ice production apparatus will hereinafter be described with reference to FIG. 1.

Referring to FIG. 1, there is schematically shown, in block form, a conventional automatic ice production apparatus. As shown in this drawing, the conventional automatic ice production apparatus comprises a power supply unit 1 for supplying power to the automatic ice production apparatus, a tray position discriminator 2 for discriminating a turned or rotation position of a tray (not shown), a function selector 3 for allowing the user to select an automatic ice producing function, an ice removing motor rotation controller 5 for controlling a rotating operation of an ice removing motor 4, a water supply motor rotation controller 7 for controlling a water supply motor 6 which supplies water to the tray, an ice removing discriminator 8 (provided under the tray), for checking an ice removing state, and a microcomputer 9 for controlling the above-mentioned components in the automatic ice production apparatus.

The operation of the conventional automatic ice production apparatus with the above-mentioned construction will hereinafter be described.

When an automatic ice producing function key on the function selector 3 is operated by the user to select the automatic ice producing function, a corresponding signal is applied to the microcomputer 9 which is also supplied with a drive voltage from the power supply unit 1.

Upon receiving the automatic ice producing function key signal from the function selector 3, the microcomputer 9 outputs a control signal to the water supply motor rotation controller 7 to drive the water supply motor 6. As the water supply motor 6 is driven, water from a water supply tank is supplied to the tray. At this time, the tray remains in a horizontal state.

Thereafter, the ice removing discriminator 8 checks whether an ice producing operation has been completed. If it is checked that the ice producing operation has been completed, the ice removing discriminator 8 outputs a control signal to the microcomputer 9 to inform it of such a situation. In response to the control signal from the ice removing discriminator 8, the microcomputer 9 outputs a control signal to the ice removing motor rotation controller 5 to rotate the ice removing motor 4 in a desired direction. As the ice removing motor 4 is rotated, the tray is turned to an ice container. At this time, the tray is held at one side by a stopper while a rotating force is continuously applied at its other side with the ice removing motor 4. As a result, the tray is distorted.

As the tray is distorted, produced ice is removed therefrom and collected in the ice container. Then, the ice removing discriminator 8 checks whether an ice removing operation has been completed. If it is determined that the ice removing operation has been completed, the ice removing discriminator 8 outputs a control signal to the microcomputer 9 to inform it of such a situation. In response to the control signal from the ice removing discriminator 8, the microcomputer 9 controls the ice removing motor rotation controller 5 to rotate the ice removing motor 4 in a reverse direction. As a result, the tray is returned to its initial state.

Then, the tray position discriminator 2 checks whether the tray has been returned to its horizontal state. If it is determined that the tray has been returned to its horizontal state, the tray position discriminator 2 outputs a control signal to the microcomputer 9 to inform it of such a situation. In response to the control signal from the tray position discriminator 2, the microcomputer 9 repeats the above described ice producing operation.

In the case where an ice full switch (not shown) remains at its ON state even at the horizontal state of the tray because the ice container is filled with the produced ice, the microcomputer 9 stops the entire operation of the automatic ice production apparatus.

However, the above-mentioned conventional automatic ice production apparatus has the following disadvantages.

First, as the tray is turned only in the single direction to perform the ice removing operation, it is continuously distorted in the same direction. For this reason, it is difficult for the tray to retain its original form. This results in a reduction in life of the tray.

Second, because the tray is distorted to perform the ice removing operation, an overload is applied to the ice removing motor, resulting in a reduction in life of the ice removing motor and frequent breakdown.

Third, there is no function for indicating that the level of water in the water supply tank is below a predetermined value. As a result, the user must personally check the water level in the water supply tank. This is inconvenient to the user.

Fourth, when the automatic ice production function and the dispenser are simultaneously driven in a refrigerator with both of them, they are simultaneously supplied with water pumped by the water supply motor. As a result, the amount of water discharged from the dispenser is reduced. For this reason, the user must operate the dispenser for a longer time to obtain a desired amount of water therefrom.

Fifth, the remaining water in a water supply hose to the tray may freeze due to the temperature of a freezer compartment of the refrigerator. In this case, water from the water supply tank cannot be supplied to the tray.

Another conventional ice production apparatus is described in JP, A, 92-111384. This conventional apparatus comprises: an ice production chamber installed in a cooling device, whereto cool air is supplied; an ice production tray which is separable; an ice production machine which has a driving device for rotating the ice production tray; a checking means for checking whether an ice production operation has been completed; a discriminating means for discriminating a turned position of the ice production tray; a detecting means for detecting the amount of ice which is contained in an ice container under the ice production tray; a control means for controlling the driving device by signals from the checking means, discriminating means, and detecting means; a connector for connecting signal lines of the control means with signal lines of the checking means, discriminating means, and detecting means; and a determining means for determining whether the ice production machine is separated with the ice production chamber, when all the signal lines of the control means is open. According to the prior art described in the above, there is provided an ice production apparatus, wherein an ice production operation can be performed by determining whether an ice production machine has been separated with an ice production chamber. This apparatus has the same disadvantage in that the tray is distorted in the single direction during the ice removing operation, thereby reducing life of the tray.

SUMMARY OF THE INVENTION

Therefore, the present invention has been made in view of the above problems, and it is an object of the present invention to provide an automatic ice production apparatus and a method which has an ice removing motor rotation control function for controlling a rotating operation of an ice removing motor in such a manner that it can alternately perform a normal direction ice removing operation and a reverse direction ice removing operation.

It is another object of the present invention to provide an automatic ice production apparatus and a method which has an ice removing motor protection function for detecting a load amount applied by an ice removing motor when an ice removing operation is performed and protecting the ice removing motor from an overload state in accordance with the detected result.

It is a further object of the present invention to provide an automatic ice production apparatus and a method which has a water supply alarm/indication function for detecting the level of water in a water supply tank and, if the detected water level is below a predetermined value, generating an alarm to automatically indicate the proper time that the water supply tank is to be replenished with water.

It is a further object of the present invention to provide an automatic ice production apparatus and a method which has a water supply state control function for, when the automatic ice production is driven simultaneously with a dispenser, stopping the automatic ice production and preferentially supplying water to the dispenser.

It is yet another object of the present invention to provide an automatic ice production apparatus and a method which has a water supply motor control function for preventing the freezing of the remaining water in a water supply hose to the tray by rotating a water supply motor in the reverse direction to feed the remaining water in the water supply hose back to a water supply tank.

In accordance with the present invention, the above and other objects can be accomplished by a provision of an automatic ice production apparatus comprising a power supply unit for supplying power to the automatic ice production apparatus, an ice removing motor for turning a tray in a desired direction to perform an ice removing operation of the automatic ice production apparatus, a water supply motor for pumping water from a water supply tank, a tray position discriminator for determining a rotation position of the tray, a function selector for allowing a user to select various functions of the automatic ice production, a dispenser for supplying drinking water to the user and an ice removing discriminator for checking an ice producing state, wherein the improvement comprises ice removing motor rotation control means for controlling a rotating operation of the ice removing motor; water supply motor rotation control means for controlling a rotating operation of the water supply motor; water supply state control means for controlling the supply of the water pumped by the water supply motor to the tray and the dispenser; water level detection means for detecting the level of water in the water supply tank; alarm generation means for generating an alarm in response to the water level detected by the water level detection means; and system control means for controlling the entire operation of the automatic ice production apparatus.

The ice removing motor rotation control means includes normal direction and reverse direction switching means for switching a drive voltage from the power supply unit to the ice removing motor to control a rotating direction of the ice removing motor; and switching control means for controlling ON/OFF states of the normal direction and reverse direction switching means under the control of the system control means.

The normal direction switching means includes a first switching transistor for switching the drive voltage from the power supply unit to one terminal of the ice removing motor; and a second switching transistor for switching a ground voltage to the other terminal of the ice removing motor.

The reverse direction switching means includes a third switching transistor for switching the drive voltage from the power supply unit to the other terminal of the ice removing motor; and a fourth switching transistor for switching the ground voltage to the one terminal of the ice removing motor.

The switching control means includes a first control transistor for controlling the ON/OFF states of the normal direction switching means in response to a first control signal from the system control means; and a second control transistor for controlling the ON/OFF states of the reverse direction switching means in response to a second control signal from the system control means.

The water supply motor rotation control means includes normal direction and reverse direction switching means for switching a drive voltage from the power supply unit to the water supply motor to control a rotating direction of the water supply motor; and switching control means for controlling ON/OFF states of the normal direction and reverse direction switching means under the control of the system control means.

The normal direction switching means includes a first switching transistor for switching the drive voltage from the power supply unit to one terminal of the water supply motor; and a second switching transistor for switching a ground voltage to the other terminal of the water supply motor.

The reverse direction switching means includes a third switching transistor for switching the drive voltage from the power supply unit to the other terminal of the water supply motor; and a fourth switching transistor for switching the ground voltage to the one terminal of the water supply motor.

The switching control means includes a first control transistor for controlling the ON/OFF states of the normal direction switching means in response to a first control signal from the system control means; and a second control transistor for controlling the ON/OFF states of the reverse direction switching means in response to a second control signal from the system control means.

The water supply state control means includes a dispenser switch disposed at a desired position outside a refrigerator in such a manner that it can be operated by the user; opening/closing means being driven in response to a drive voltage from the power supply unit to control the supply of water to the automatic ice production apparatus; switching means for switching a ground voltage to the opening/closing means to control ON/OFF states of the opening/closing means; and switching control means for controlling the switching operation of the switching means according to ON/OFF states of the dispenser switch.

The opening/closing means is turned on in response to the switching means being turned on, to open a water path between the water supply tank and the dispenser to supply the water pumped by the water supply motor to the dispenser and it is turned off in response to the switching means being turned off, to open a water path between the water supply tank and the automatic ice production apparatus to supply the water pumped by the water supply motor to the automatic ice production apparatus.

The switching control means turns on the switching means in response to the dispenser switch being turned on, to open a water path between the water supply tank and the dispenser and it turns off the switching means in response to the dispenser switch being turned off, to open a water path between the water supply tank and the automatic ice production apparatus.

The water level detection means includes a chamber defined in a given position inside a fresh food compartment of a refrigerator, for receiving the water supply tank; a water level sensor fixedly mounted to the bottom center of the chamber, the water level sensor being axially grooved and thereby forming an axial channel sided by opposite side walls; sensor receiving means vertically formed at the bottom center of the water supply tank, for allowing the water supply tank to smoothly slide inside the chamber, the sensor receiving means including a pair of parallel grooves which axially extend on the bottom of the water supply tank and slidably receive the opposite side walls of the water level sensor, respectively; transparent windows provided respectively at the opposite side walls of the grooves; and optical transmission/reception means disposed in the water level sensor, for transmitting and receiving an optical signal.

The optical transmission/reception means includes a photodiode provided at one of the opposite side walls of the water level sensor, for transmitting the optical signal; and a phototransistor provided at the other of the opposite side walls of the water level sensor, for receiving the optical signal from the photodiode.

The alarm generation means includes a light emitting diode for generating an optical signal, the light emitting diode having its cathode terminal for inputting a drive voltage from the power supply unit and its anode terminal for inputting a control signal from the system control means.

The automatic ice production apparatus further comprises ice removing motor protection means for detecting a load amount applied to the ice removing motor and protecting the ice removing motor from an overload state in accordance with the detected result.

The ice removing motor protection means includes voltage detection means connected to the ice removing motor, for detecting a voltage applied to the ice removing motor when the ice removing motor is rotated in normal and reverse directions; a pair of voltage dividing resistors for dividing a drive voltage from the power supply unit at a desired ratio; and a comparator having its non-inverting input terminal for supplying a voltage divided by the voltage dividing resistors and its inverting input terminal for supplying one of the voltages detected by the voltage detection means, the comparator comparing the supplied two voltages with each other and outputting the compared result to the system control means to control the operation of the ice removing motor.

The voltage detection means includes a first voltage detection resistor connected to one terminal of the ice removing motor, for detecting the voltage applied to the ice removing motor when the ice removing motor is rotated in the normal direction; and a second voltage detection resistor connected to the other terminal of the ice removing motor, for detecting the voltage applied to the ice removing motor when the ice removing motor is rotated in the reverse direction.

The system control means is programmed to perform an ice removing motor rotation control step for alternatively performing a normal direction ice removing operation and a reverse direction ice removing operation; an ice removing motor protection step for controlling the operation of the ice removing motor in response to a control signal from ice removing motor protection means; a water supply alarm/indication step for controlling the water level detection means to detect the level of water in the water supply tank and, if the detected water level is below a predetermined value, for generating an alarm; a water supply state control step for, when the automatic ice production and the dispenser are simultaneously driven, stopping the operation of the automatic ice production and preferentially supplying water to the dispenser; and a water supply motor control step for rotating the water supply motor in the reverse direction to feed water remaining in a water supply hose back to the water supply tank, thereby preventing the freezing of the remaining water in the water supply hose.

The ice removing motor rotation control step includes the step of initializing a count if an automatic ice producing function is selected by the user, checking whether the count is an even number or an odd number, alternately performing the normal direction ice removing operation and the reverse direction ice removing operation in accordance with the checked result, so that the tray may rotate repeatedly in the normal direction and in the reverse direction.

The ice removing motor protection step includes the step of, if the control signal from the ice removing motor protection means has a first logic state, a normal-load state, turning on the ice removing motor rotation control means to normally drive the ice removing motor and, if the control signal from the ice removing motor protection means has a second logic state, an overload state, turning off the ice removing motor rotation control means to stop the operation of the ice removing motor.

The water supply alarm/indication step includes the step of calculating the capacity of the water supply tank, ascertaining a water supply amount, calculating a difference between the calculated capacity of the water supply tank and the ascertained water supply amount to obtain the amount of water remaining in the water supply tank and, if the obtained water amount is below a predetermined value, controlling the alarm generation means to generate an alarm.

Ascertaining the water supply amount can be performed by multiplying a water supply performance of the water supply motor by a time used, where the water supply performance of the water supply motor is a pumped water amount per second.

The water supply alarm/indication step includes the steps of initializing a counting operation if the water supply alarm/indication mode is in the initial state in which the water supply tank is filled with water by the user; driving the water supply motor and starting the counting operation; stopping the water supply motor and the counting operation when a predetermined time period has elapsed and multiplying a water supply performance of the water supply motor by the used time to calculate the water supply amount; calculating the difference between the capacity of the water supply tank and the calculated water supply amount to obtain the amount of water remaining in the water supply tank; and checking whether the obtained water amount is below the predetermined value and, if the obtained water amount is below the predetermined value, controlling the alarm generation means to generate the alarm.

The water supply alarm/indication step includes the step of detecting the initial temperature of the tray after the ice removing operation is completed, detecting the present temperature of the tray after water from the water supply tank is supplied to the automatic ice production apparatus, calculating a difference between the detected initial and present temperatures of the tray and, if the calculated difference is below a predetermined value, controlling the alarm generation means to generate the alarm.

The water supply alarm/indication step includes the steps of detecting the initial temperature of the tray at the initial state that the ice removing operation is completed; controlling the water supply motor rotation control means to drive the water supply motor for a predetermined time period and then detecting the present temperature of the tray; and calculating the difference between the detected initial and present temperatures of the tray and, if the calculated difference is below the predetermined value, controlling the alarm generation means to generate the alarm.

The water supply state control step includes the steps of checking whether a dispenser switch disposed at a desired position outside a refrigerator has been turned on by the user; turning on a solenoid valve if it is determined that the dispenser switch has been turned on by the user and driving the water supply motor to supply water to the dispenser; checking whether the automatic ice production is in a water supply mode, if the dispenser switch is turned off; and turning off the solenoid valve if it is determined that the automatic ice production is in the water supply mode and driving the water supply motor to supply water to the tray for a predetermined time period.

The water supply motor control step includes the steps of supplying water to the tray if the automatic ice production is in a water supply mode and then controlling the water supply motor rotation control means to rotate the water supply motor in the reverse direction for a predetermined time period; and controlling the water supply motor rotation control means to stop the water supply motor, when the predetermined time period has elapsed.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENTS

In the following, one preferred embodiment of an automatic ice production apparatus and a method thereof according to the present invention will be described in detail with reference to the accompanying drawings.

Figure 1:
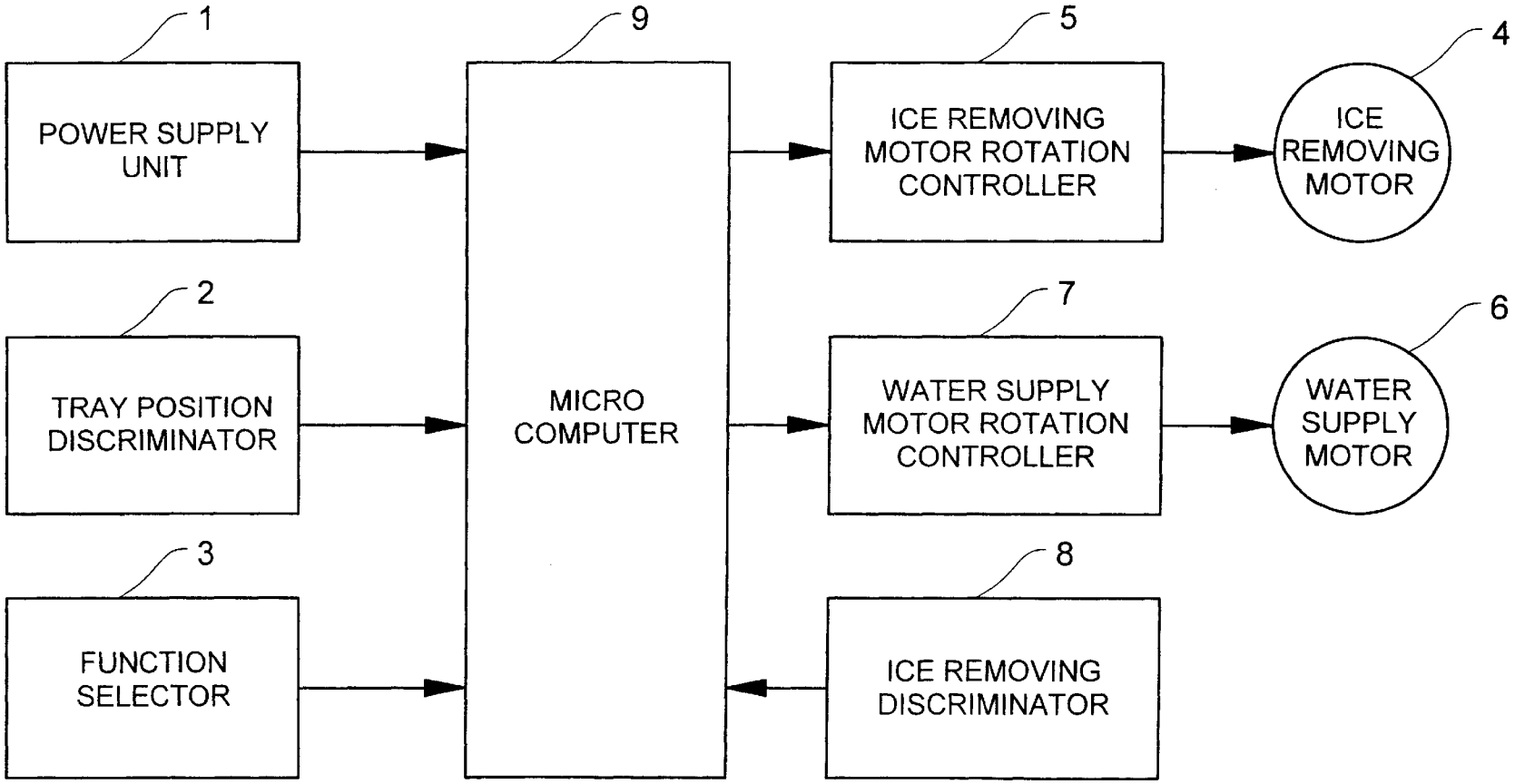
FIG. 1 is a schematic block diagram illustrating the construction of a conventional automatic ice production apparatus.
Figure 2:
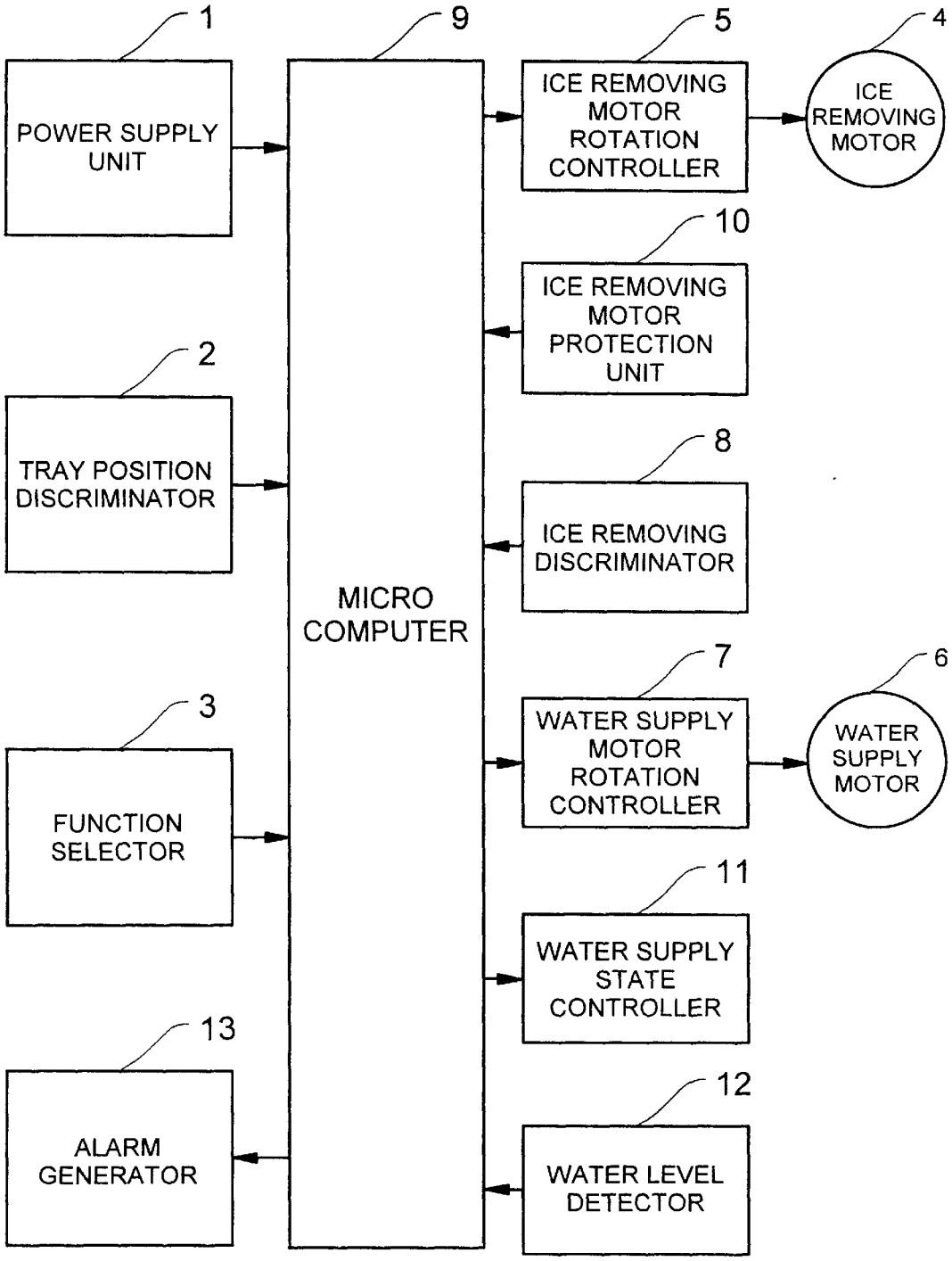
FIG. 2 is a schematic block diagram illustrating the construction of an automatic ice production apparatus in accordance with the present invention.

Referring to FIG. 2, there is schematically shown, in block form, the construction of an automatic ice production apparatus. Some parts in this drawing are the same as those in FIG. 1. Therefore, like reference numerals designate like parts.

As shown in FIG. 2, the automatic ice production apparatus comprises a power supply unit 1 for supplying power to the automatic ice production apparatus, a tray position discriminator 2 for discriminating a rotation position of a tray, a function selector 3 for allowing a user to select an automatic ice producing function, an ice removing motor rotation controller 5 for controlling a rotating operation of an ice removing motor 4, a water supply motor rotation controller 7 for controlling operation of a water supply motor 6 which supplies water to the tray, and an ice removing discriminator 8 provided under the tray, for checking an ice removing state.

The automatic ice production apparatus further comprises an ice removing motor protection unit 10 for detecting a load amount applied to the ice removing motor 4 and protecting the ice removing motor 4 from an overload state in accordance with the detected result, a water supply state controller 11 for controlling the supply of water to the tray and a dispenser, a water level detector 12 for detecting the level of water in a water supply tank, an alarm generator 13 for generating an alarm when the water level detected by the water level detector 12 is below a predetermined value, and a microcomputer 9 for controlling the above-mentioned components in the automatic ice production apparatus.

Figure 3:
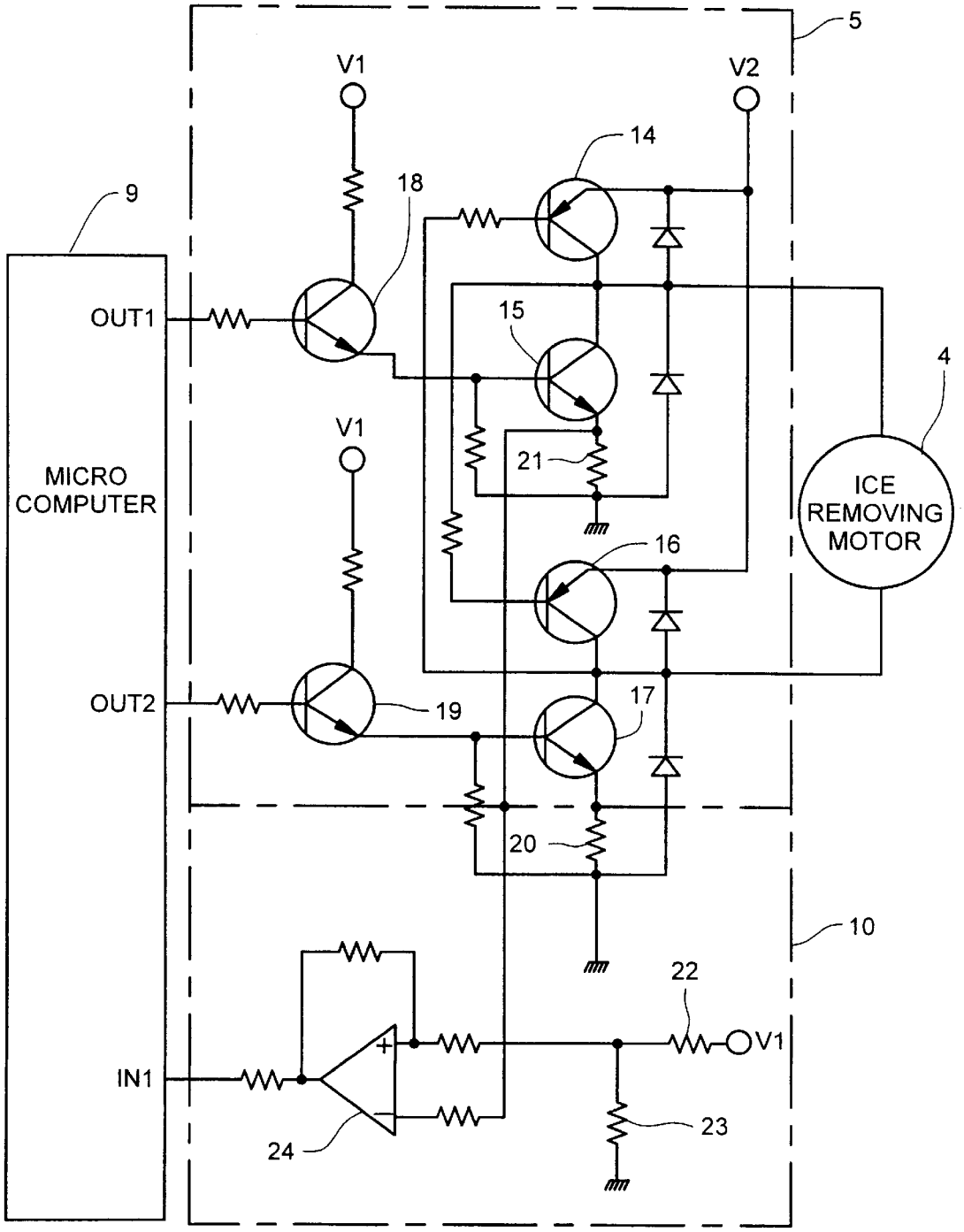
FIG. 3 is a detailed circuit diagram of an ice removing motor rotation controller and an ice removing motor protection unit in FIG. 2.

Referring to FIG. 3, there is shown a detailed circuit diagram of the ice removing motor rotation controller 5 and ice removing motor protection unit 10 in FIG. 2. As shown in this drawing, the ice removing motor rotation controller 5 includes a plurality of switching transistors 14–17 for switching a drive voltage V2 from the power supply unit 1 to the ice removing motor 4 to control a rotating direction of the ice removing motor 4, and a pair of control transistors 18 and 19 being switched under the control of the microcomputer 9 to control the switching operations of the switching transistors 14–17.

The switching transistors 15 and 17 are adapted to switch a ground voltage to the ice removing motor 4 and the switching transistors 14 and 16 are adapted to switch the drive voltage V2 from the power supply unit 1 to the ice removing motor 4.

Also, the switching transistors 15 and 16 are complementarily driven in response to ON and OFF states of the control transistor 18 and the switching transistors 14 and 17 are complementarily driven in response to ON and OFF states of the control transistor 19.

Also as shown in FIG. 3, the ice removing motor protection unit 10 includes a voltage detection resistor 20 connected to an emitter terminal of the switching transistor 17 in the ice removing motor rotation controller 5, for detecting a voltage applied to the ice removing motor 4 when the ice removing motor 4 is rotated in the normal direction, a voltage detection resistor 21 connected to an emitter terminal of the switching transistor 15 in the ice removing motor rotation controller 5, for detecting a voltage applied to the ice removing motor 4 when the ice removing motor 4 is rotated in the reverse direction, a pair of voltage dividing resistors 22 and 23 for dividing a drive voltage V1 from the power supply unit 1 at a desired ratio, and a comparator 24 for inputting the voltage detected by the voltage detection resistor 20 or 21 at its inverting input terminal (−) and a voltage divided by the voltage dividing resistors 22 and 23 at its non-inverting input terminal (+), comparing the inputted two voltages with each other and outputting the compared result to the microcomputer 9.

Figure 4:
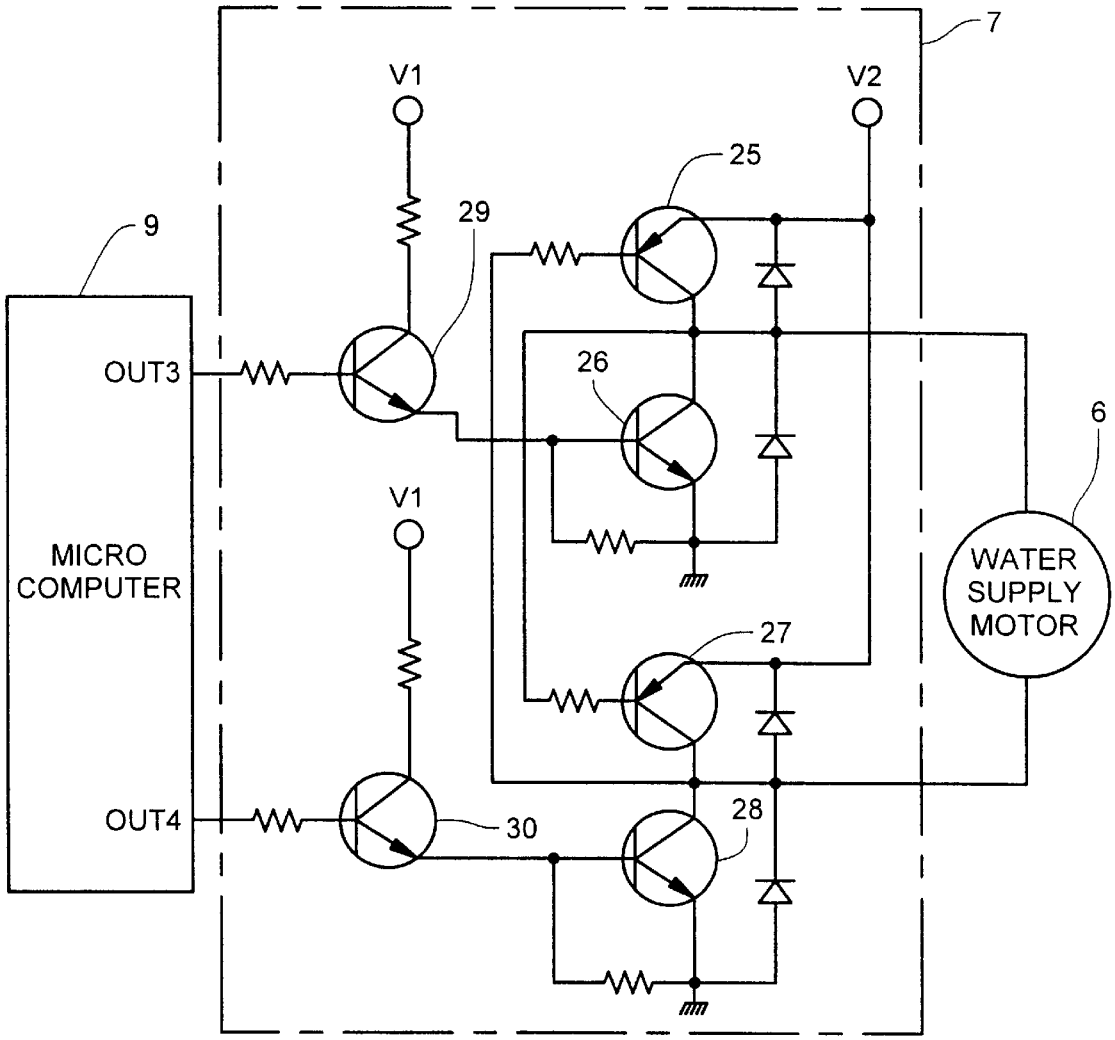
FIG. 4 is a detailed circuit diagram of a water supply motor rotation controller in FIG. 2.

Referring to FIG. 4, there is shown a detailed circuit diagram of the water supply motor rotation controller 7 in FIG. 2. As shown in this drawing, the water supply motor rotation controller 7 includes a plurality of switching transistors 25–28 for switching the drive voltage V2 from the power supply unit 1 to the water supply motor 6 to control a rotating direction of the water supply motor 6, and a pair of control transistors 29 and 30 being switched under the control of the microcomputer 9 to control the switching operations of the switching transistors 25–28.

The switching transistors 26 and 28 are adapted to switch the ground voltage to the water supply motor 6 and the switching transistors 25 and 27 are adapted to switch the drive voltage V2 from the power supply unit 1 to the water supply motor 6.

Also, the switching transistors 26 and 27 are complementarily driven in response to ON and OFF states of the control transistor 29 and the switching transistors 25 and 28 are complementarily driven in response to ON and OFF states of the control transistor 30.

Figure 5:
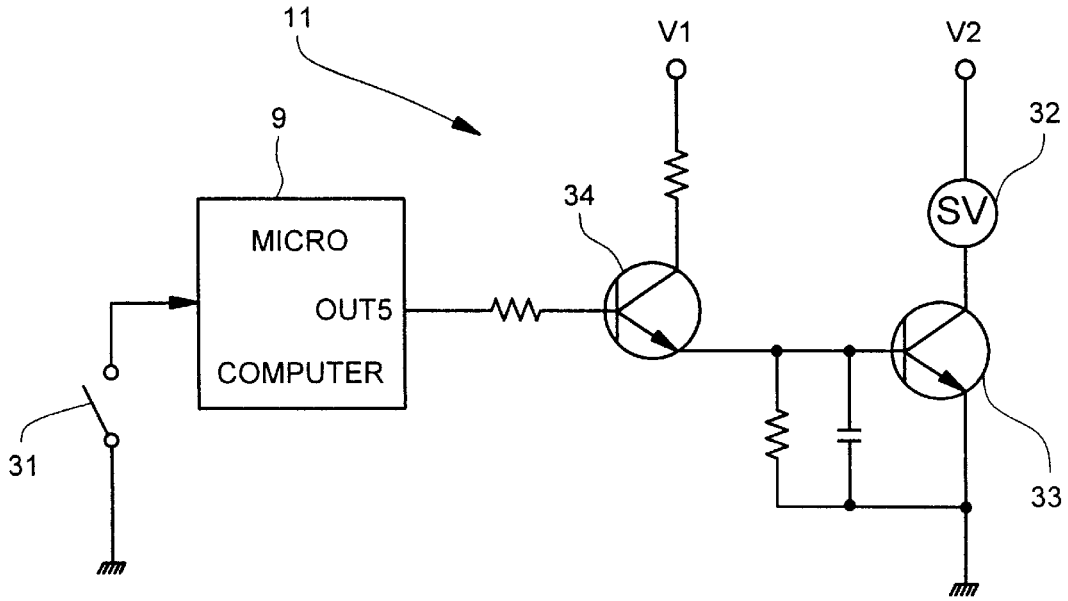
FIG. 5 is a detailed circuit diagram of a water supply state controller in FIG. 2.

Referring to FIG. 5, there is shown a detailed circuit diagram of the water supply state controller 11 in FIG. 2. As shown in this drawing, the water supply state controller 11 includes a dispenser switch 31 disposed at a desired position outside a refrigerator in such a manner that it can be operated by the user, a solenoid valve 32 being driven in response to the drive voltage V2 from the power supply unit 1 to control the supply of water to the tray, a switching transistor 33 for switching the ground voltage to the solenoid valve 32 to control ON/OFF states of the solenoid valve 32, and a control transistor 34 being switched under the control of the microcomputer 9 based on ON/OFF states of the dispenser switch 31 to control the switching operation of the switching transistor 33.

Figure 6:
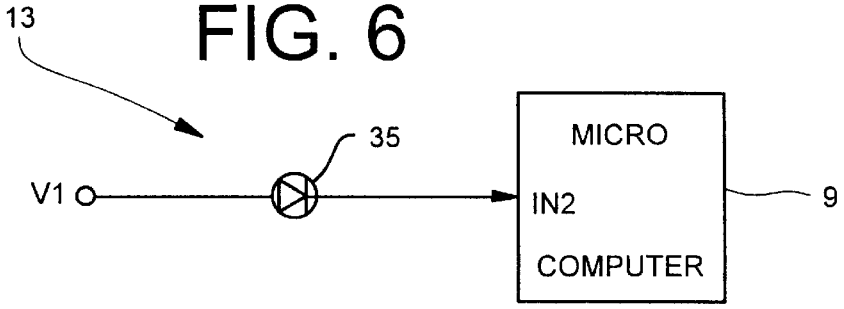
FIG. 6 is a detailed circuit diagram of an alarm generator in FIG. 2.

Referring to FIG. 6, there is shown a detailed circuit diagram of the alarm generator 13 in FIG. 2. As shown in this drawing, the alarm generator 13 includes a light emitting diode 35 being driven in response to the drive voltage V1 from the power supply unit 1 to generate an optical signal under the control of the microcomputer 9.

Figure 7A:
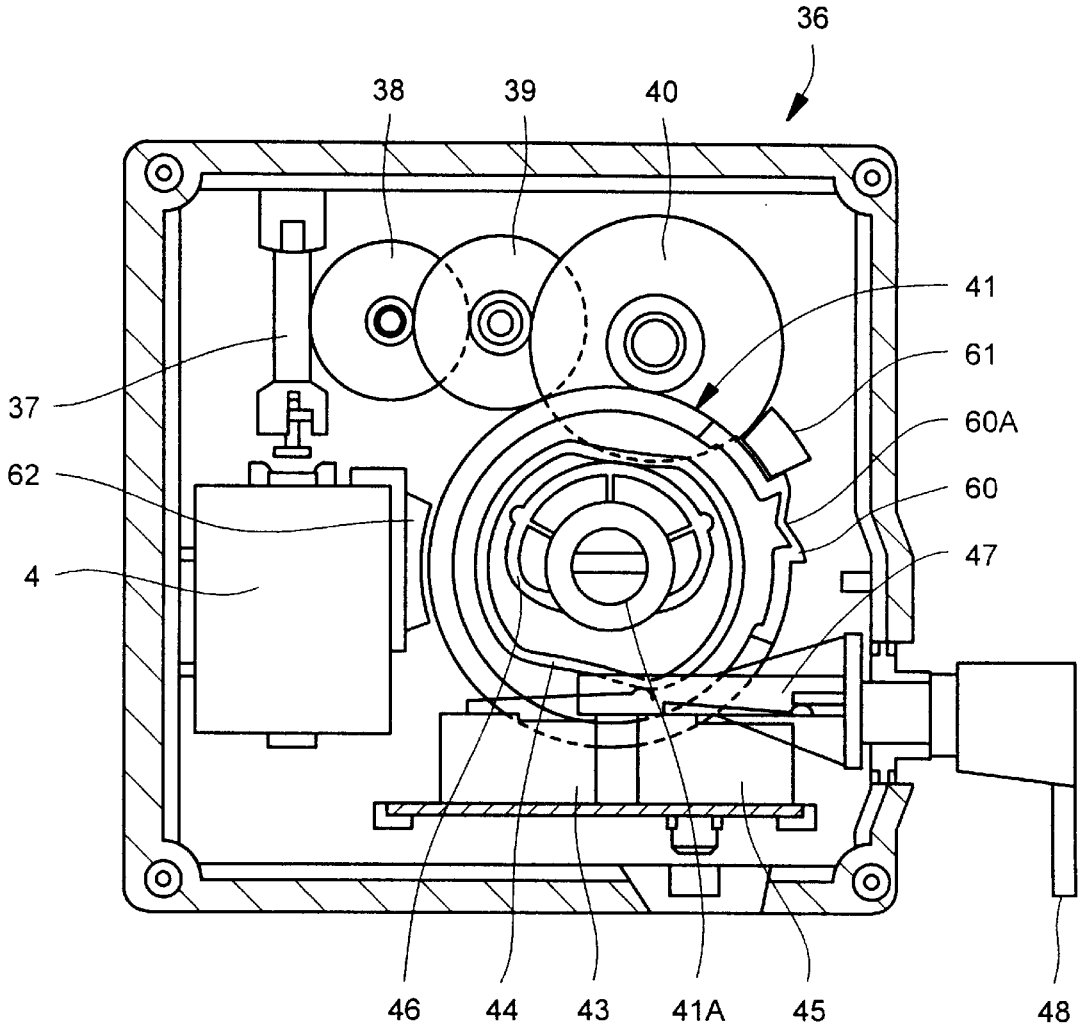
FIGS. 7A to 7C are detailed diagrams illustrating the construction of the automatic ice production apparatus in accordance with the present invention.
Figure 7B:
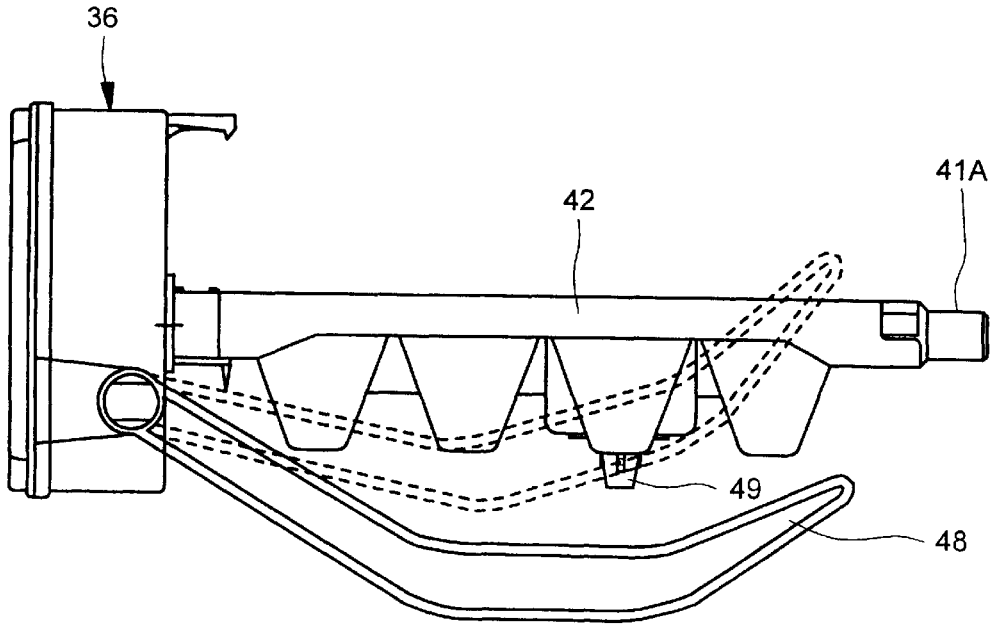
Figure 7C:
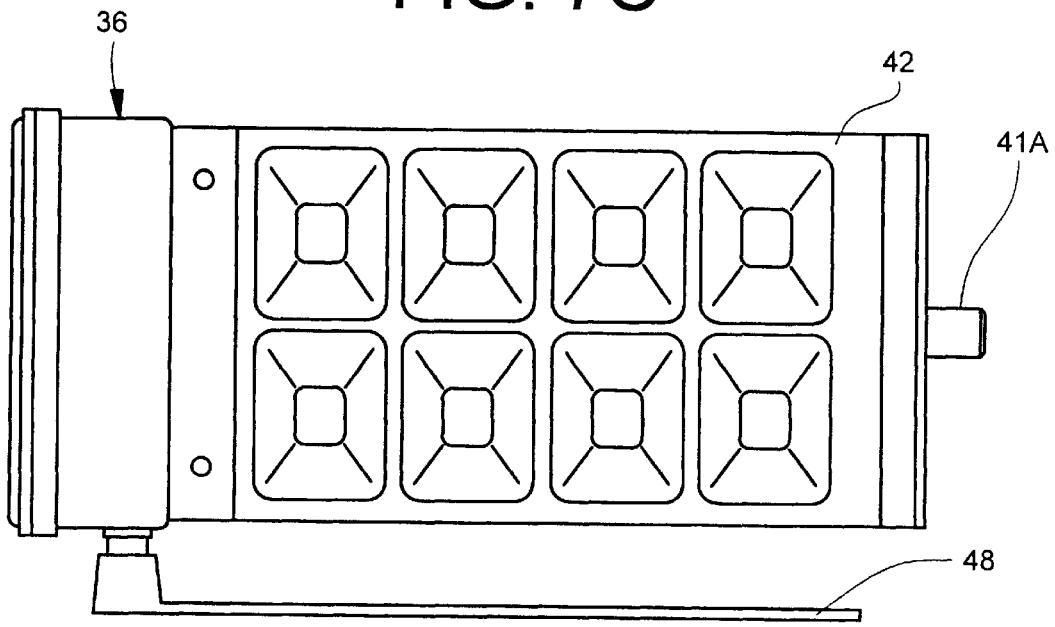

FIGS. 7A–7C are detailed diagrams illustrating the construction of the automatic ice production apparatus in accordance with the present invention. As shown in this drawing, the ice removing motor 4 is disposed at a desired position in a housing 36 of the automatic ice production apparatus. The ice removing motor 4 has its shaft to which a worm gear 37 is fixedly mounted. First to third gears 38–40 are sequentially engaged with the worm gear 37 in such a manner that they can sequentially receive a rotating force of the worm gear 37. A cam gear 41 is engaged with the third gear 40 so that it can be actuated in response to a rotating force of the third gear 40.

A tray 42 is coupled to a shaft 41A of the cam gear 41 to rotate together with said cam gear 41. A catch part 60 is formed on the periphery of the cam gear 41 such that, if the tray 42 is in the horizontal state, a horizontal stopping sill 61 may stop the rotation by contacting the catch part 60, if the cam gear 41 is over-rotated in the ice removing operation, an over-rotation preventing sill 62 may stop the rotation by contacting the catch part 60. A concave part 60A is formed on the catch part 60 to strengthen the role of the catch part 60.

A horizontal switch 43 is disposed under the cam gear 41 to sense the horizontal state of a tray 42. A horizontal switch adjustment rib 44 is mounted to the cam gear 41 to switch the horizontal switch 43.

An ice full switch 45 is disposed adjacently to the horizontal switch 43. When a lever connector 47 is pushed by an ice full lever adjustment rib 46 mounted to the cam gear 41, it turns an ice full lever 48 integral therewith, thereby causing the ice full switch 45 to be turned on.

An ice removing sensor (for example, a thermistor) 49 is disposed at a desired position under the tray 42 to sense a temperature variation of the tray 42 to check the ice producing and moving states. The ice removing sensor 49 is also mounted to the ice removing discriminator 8 to check a voltage variation based on the temperature variation of the tray 42 and to provide the checked result to the ice removing discriminator 8, thereby allowing the ice removing discriminator 8 to recognize the ice producing and moving states.

The operation of the automatic ice production apparatus with the above-mentioned construction in accordance with the present invention will hereinafter be described in detail.

First, a normal direction ice removing function and a reverse direction ice removing function of the automatic ice production apparatus in accordance with the present invention will hereinafter be described in detail with reference to FIGS. 8A to 9B.

Figure 8A:
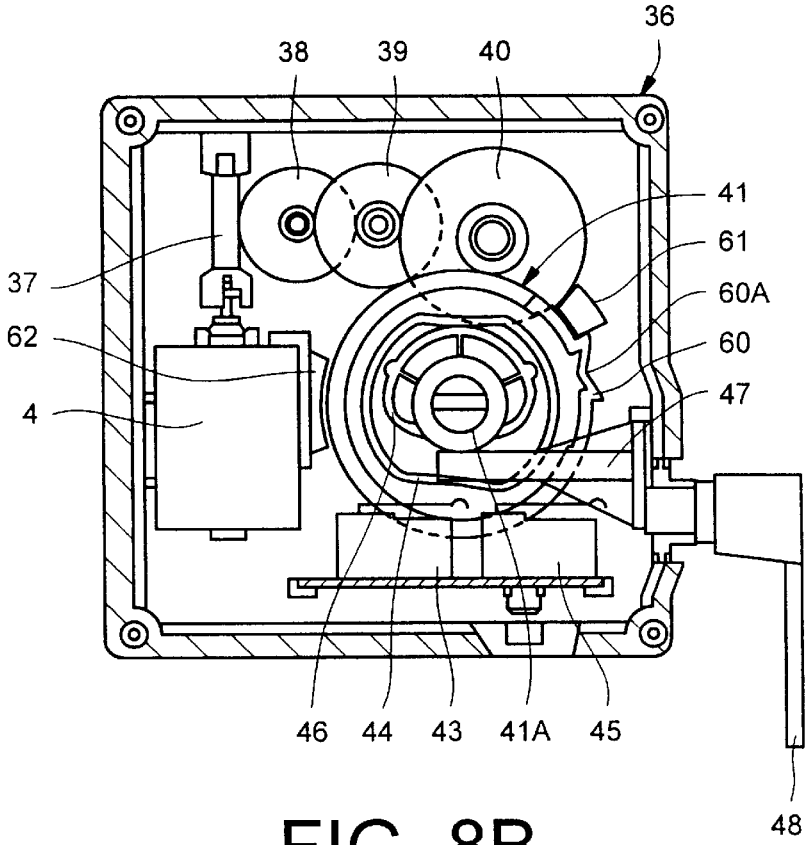
FIGS. 8A to 8G are views illustrating the operation of the automatic ice production apparatus in accordance with the present invention.
Figure 8B:
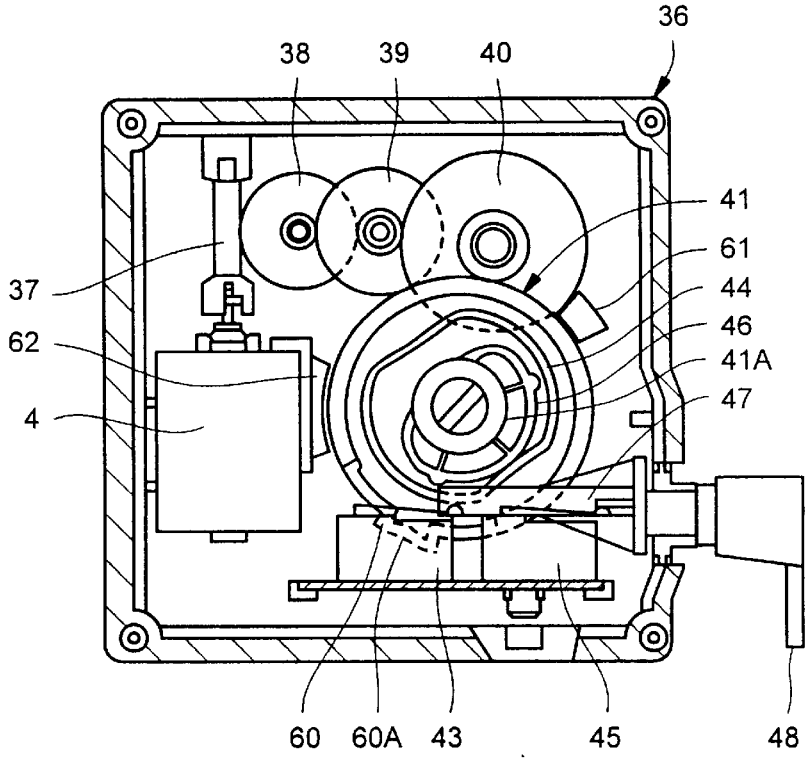
Figure 8C:
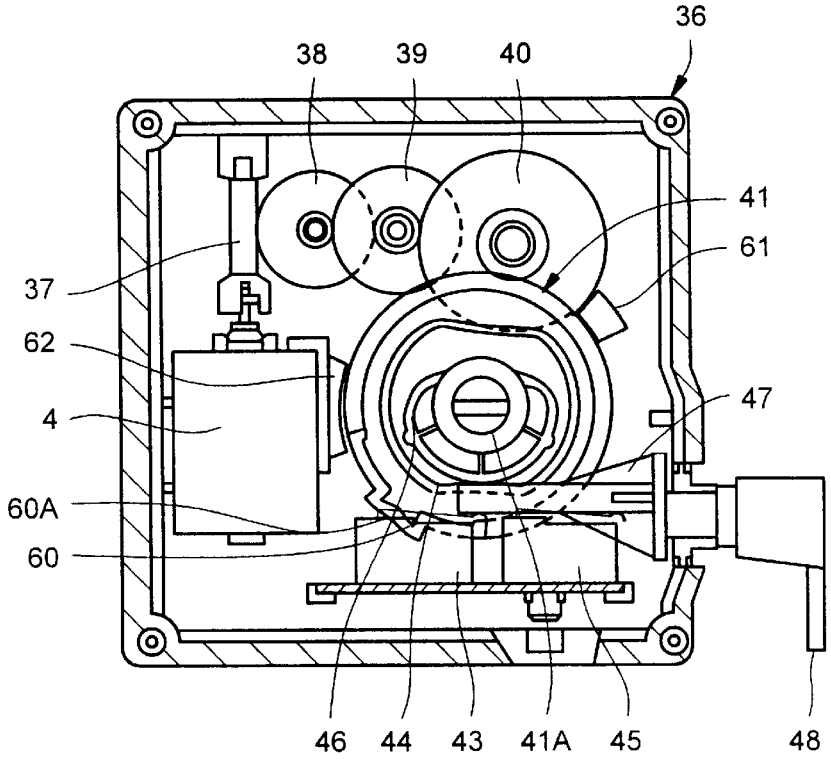
Figure 8D:
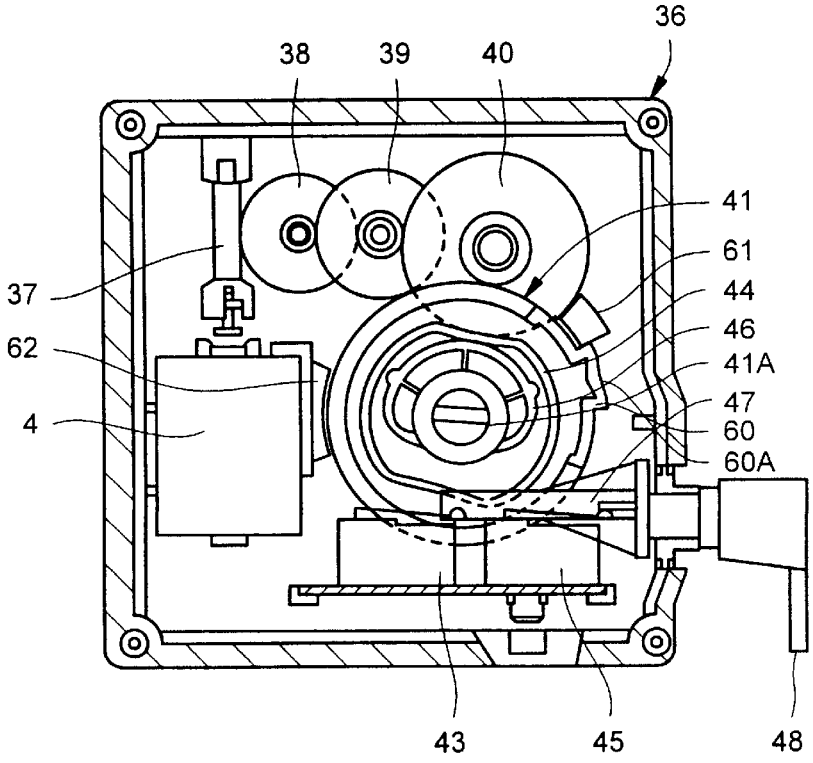
Figure 8E:
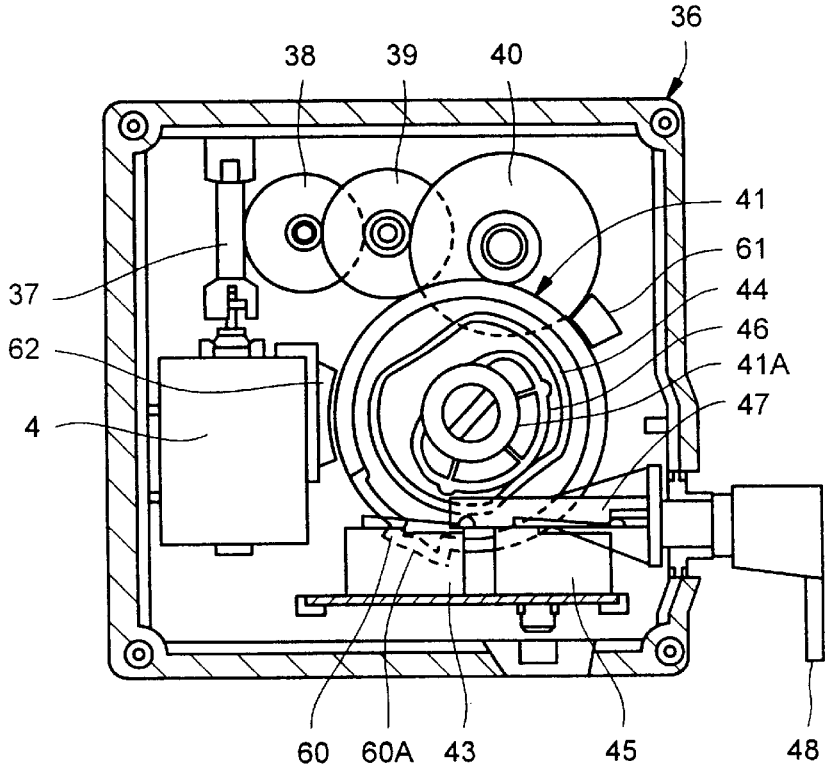
Figure 8F:
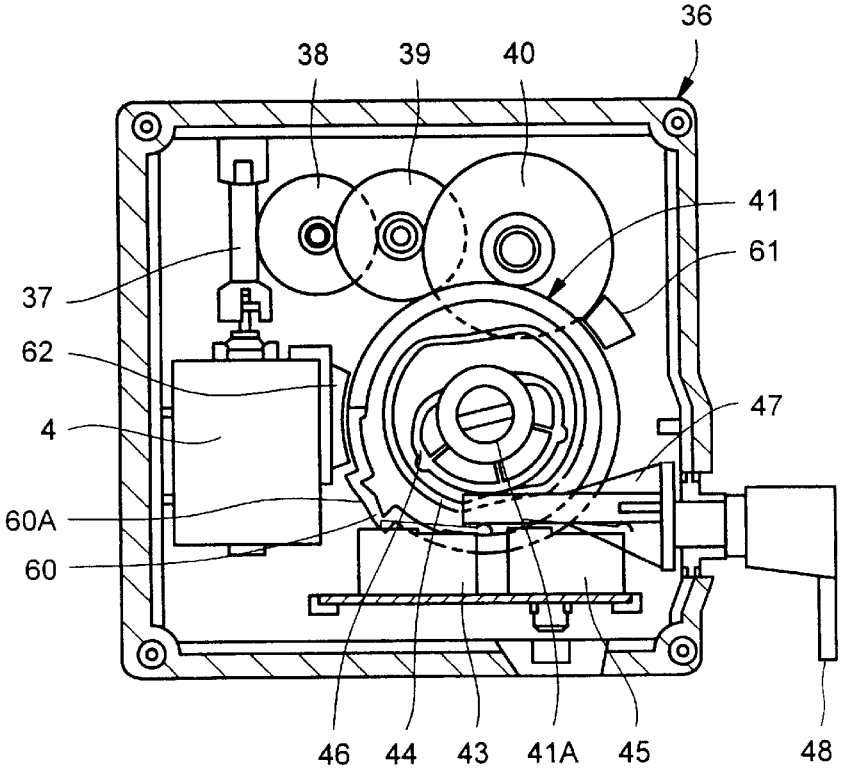
Figure 8G:
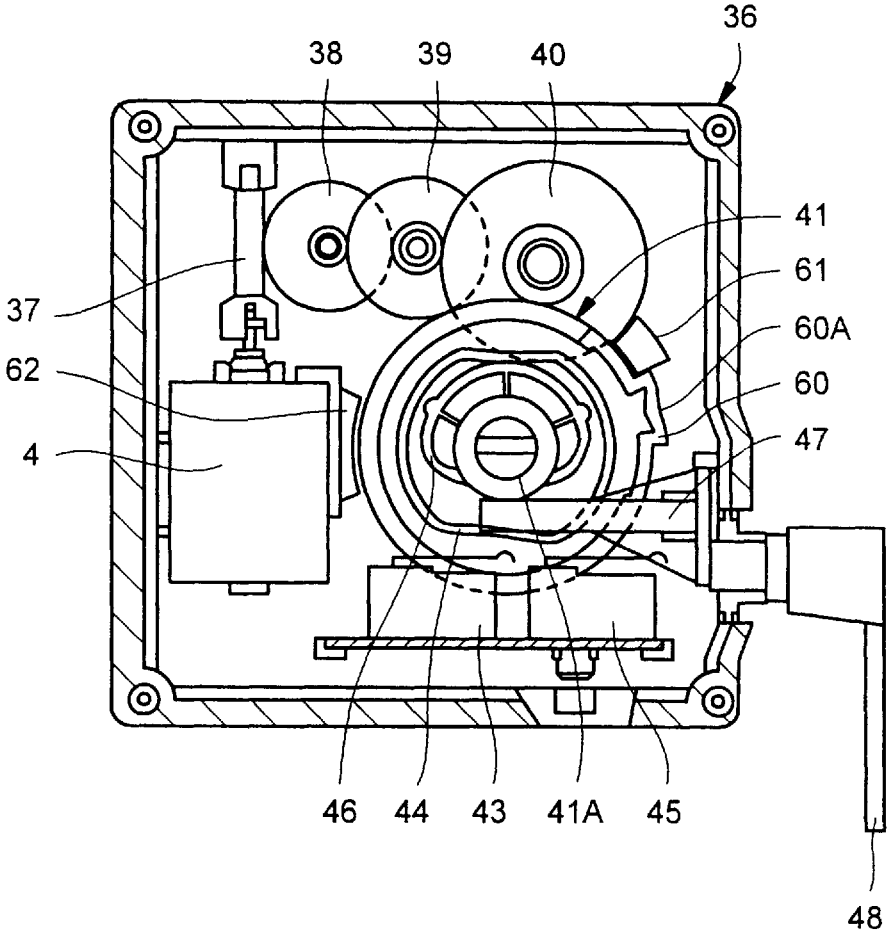
Figure 9A:
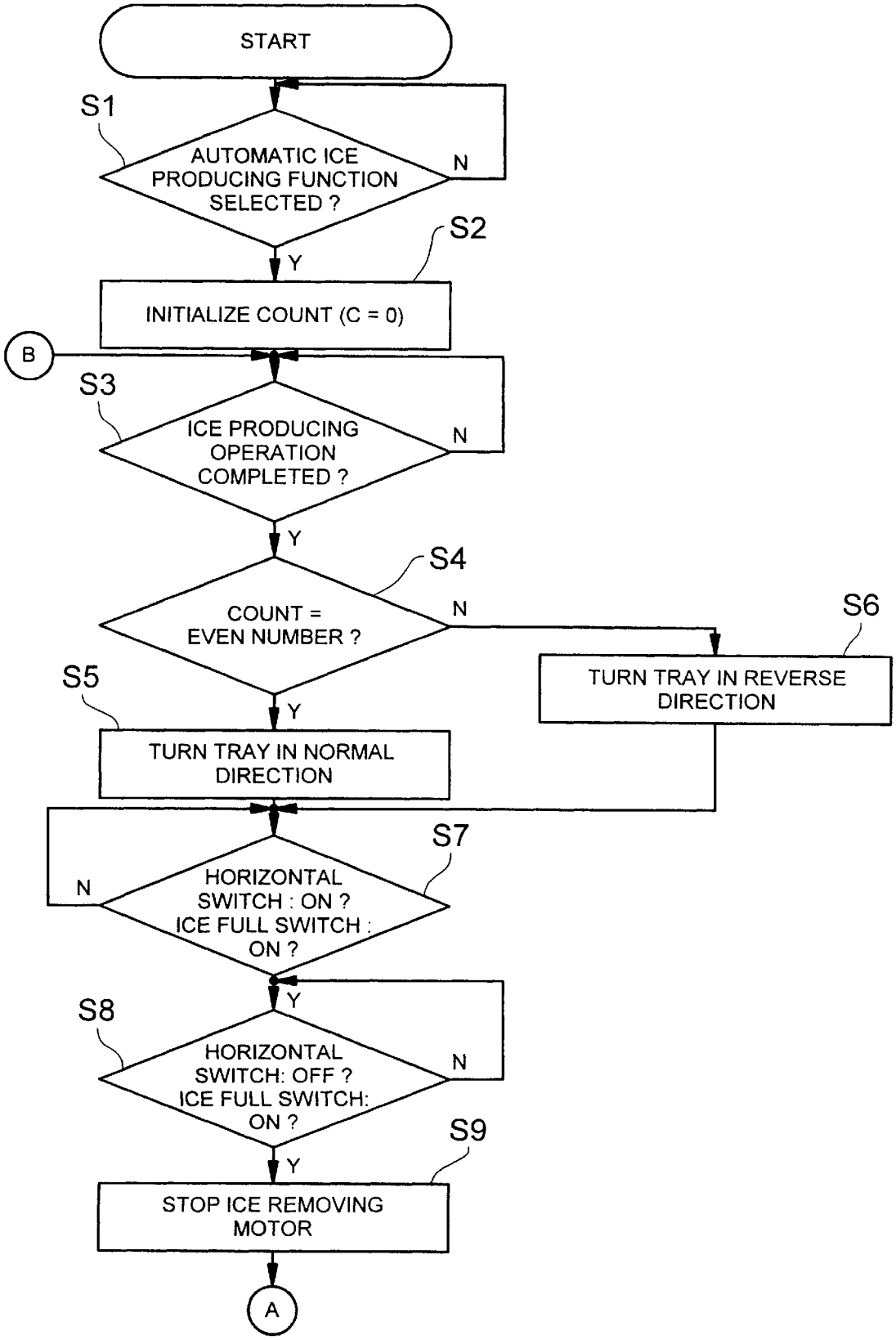
FIGS. 9A and 9B are flowcharts illustrating the operation of a microcomputer in FIG. 2 which performs a normal direction ice removing function and a reverse direction ice removing function of the automatic ice production method in accordance with the present invention.
Figure 9B:
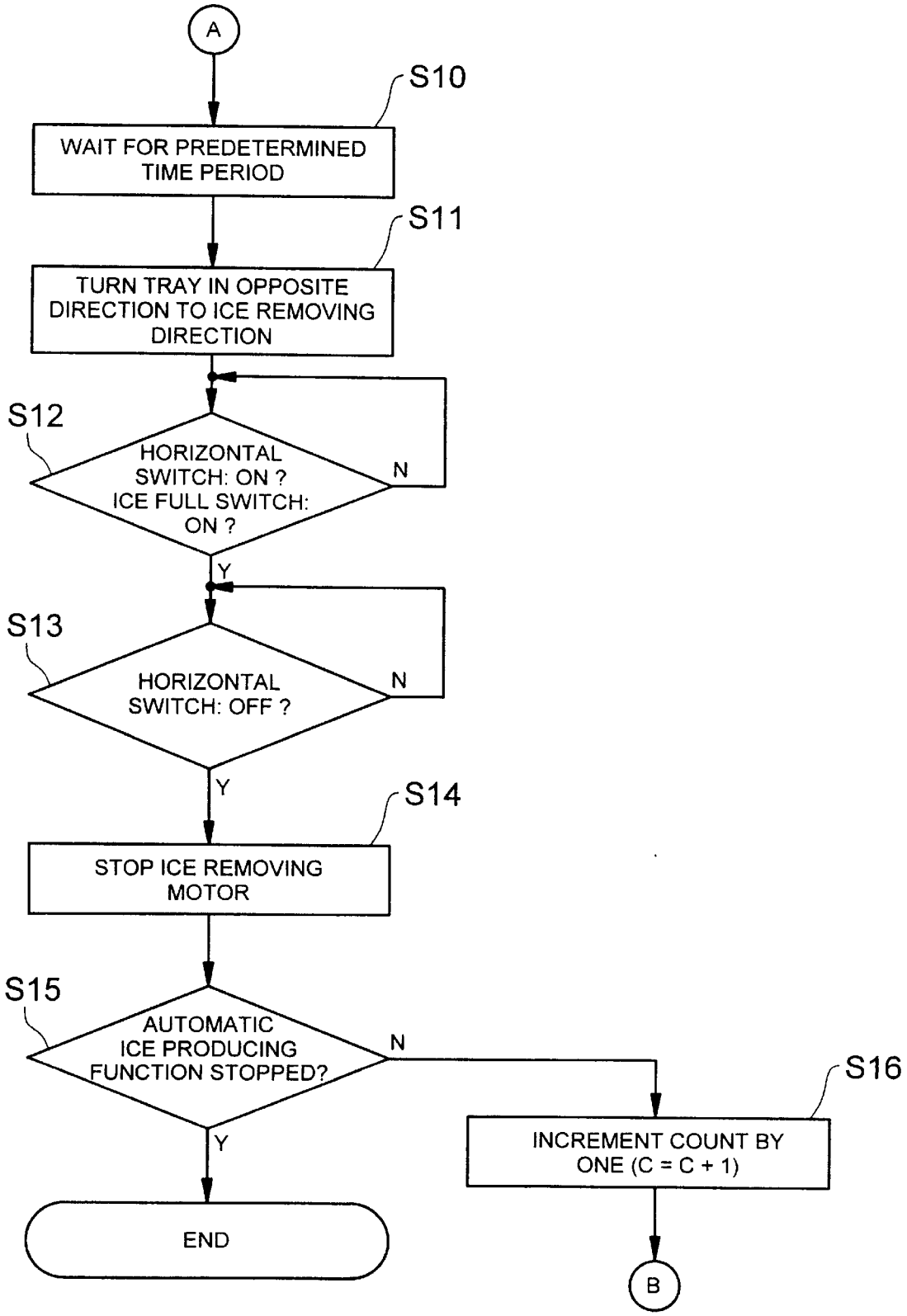

FIGS. 8A to 8G are views illustrating the operation of the automatic ice production apparatus in accordance with the present invention and FIGS. 9A and 9B are flowcharts illustrating the operation of the microcomputer 9 in FIG. 2 which performs the normal direction ice removing function and reverse direction ice removing function of the automatic ice production apparatus in accordance with the present invention.

First, in FIG. 9A, the microcomputer 9 checks at step S1 whether the automatic ice producing function has been selected by the user. If the automatic ice producing function has not been selected by the user at step S1, the catch part 60 of the cam gear 41 contacts the horizontal stopping sill 61, and the horizontal switch 43 is positioned in a concave portion of the horizontal switch adjustment rib 44 mounted to the cam gear 41, as shown in FIG. 8A. As a result, the horizontal switch 43 remains at its OFF state. Also as shown in FIG. 8A, the lever connector 47 is not pushed but positioned in a concave portion of the ice full lever adjustment rib 46 mounted to the cam gear 41. As a result, the ice full lever 48 is not turned and the ice full switch 45 remains at its OFF state.

In the case where it is checked at step S1 that the automatic ice producing function has been selected by the user, the microcomputer 9 initializes a count (i.e., C=0) at step S2 and outputs a control signal to the ice removing discriminator 8 at step S3 to check whether the ice producing operation has been completed. If it is checked at step S3 that the ice producing operation has not been completed, the microcomputer 9 returns to the above step S2 to continue to check whether the ice producing operation has been completed.

When it is checked at step S3 that the ice producing operation has been completed, the microcomputer 9 checks at step S4 whether the count is an even number. If it is checked at step S4 that the count is the even number, the microcomputer 9 controls the ice removing motor rotation controller 5 at step S5 to turn the tray 42 in the normal direction. To the contrary, if it is checked at step S4 that the count is an odd number, the microcomputer 9 controls the ice removing motor rotation controller 5 at step S6 to turn the tray 42 in the reverse direction.

In other words, the microcomputer 9 outputs a low logic control signal at its first output terminal OUT1 and a high logic control signal at its second output terminal OUT2. In the ice removing motor rotation controller 5, the control transistor 18 inputs the low logic control signal from the first output terminal OUT1 of the microcomputer 9 at its base terminal and the control transistor 19 inputs the high logic control signal from the second output terminal OUT2 of the microcomputer 9 at its base terminal. Preferably, the control transistors 18 and 19 are of the NPN type. As a result, the control transistor 18 is turned off in response to the low logic control signal from the first output terminal OUT1 of the microcomputer 9 and the control transistor 19 is turned on in response to the high logic control signal from the second output terminal OUT2 of the microcomputer 9. As the control transistor 18 is turned off, the switching transistors 15 and 16 are turned off.

As the control transistor 19 is turned on, it transfers the drive voltage V1 from the power supply unit 1 to a base terminal of the switching transistor 17, thereby causing the switching transistor 17 to be turned on. As the switching transistor 17 is turned on, the ground voltage is transferred to a collector terminal of the switching transistor 17 and a low logic signal is thus applied to a base terminal of the switching transistor 14. Preferably, the switching transistor 14 is of the PNP type. As a result, the switching transistor 14 is turned on in response to the low logic signal. The turning-on of the switching transistor 14 forms a loop of power supply unit 1 switching transistor 14 ice removing motor 4 switching transistor 17 ground terminal. With the loop formed, the drive voltage V2 from the power supply unit 1 is supplied to the ice removing motor 4 to rotate it clockwise. As the ice removing motor 4 is rotated, the cam gear 41 is rotated to turn the tray 42 mounted thereto.

On the other hand, if the microcomputer 9 outputs a high logic control signal at its first output terminal OUT1 and a low logic control signal at its second output terminal OUT2, the high logic control signal from the first output terminal OUT1 is applied to the base terminal of the control transistor 18 and the low logic control signal from the second output terminal OUT2 is applied to the base terminal of the control transistor 19. Because the control transistors 18 and 19 are of the NPN type, the control transistor 18 is turned on in response to the high logic control signal from the first output terminal OUT1 of the microcomputer 9 and the control transistor 19 is turned off in response to the low logic control signal from the second output terminal OUT2 of the microcomputer 9. As the control transistor 19 is turned off, the switching transistors 14 and 17 are turned off.

As the control transistor 18 is turned on, it transfers the drive voltage V1 from the power supply unit 1 to a base terminal of the switching transistor 15, thereby causing the switching transistor 15 to be turned on. As the switching transistor 15 is turned on, the ground voltage is transferred to a collector terminal of the switching transistor 15 and a low logic signal is thus applied to a base terminal of the switching transistor 16. Preferably, the switching transistor 16 is of the PNP type. As a result, the switching transistor 16 is turned on in response to the low logic signal. The turning-on of the switching transistor 16 forms a loop of power supply unit 1 switching transistor 16 ice removing motor 4 switching transistor 15 ground terminal. With the loop formed, the drive voltage V2 from the power supply unit 1 is supplied to the ice removing motor 4 to rotate it counterclockwise. As the ice removing motor 4 is rotated, the cam gear 41 is rotated to turn the tray 42 coupled to a shaft 41A of the cam gear 41.

As stated previously, as the tray 42 is turned, the horizontal switch adjustment rib 44 mounted to the cam gear 41 is turned in such a manner that a convex portion thereof can push the horizontal switch 43 to turn it on. Also, the lever connector 47 is pushed by a convex portion of the ice full lever adjustment rib 46 mounted to the cam gear 41, so as to turn the ice full lever 48. Also, the ice full switch 45 is turned on by the lever connector 47. At this time, the microcomputer 9 checks at step S7 that the horizontal switch 43 and the ice full switch 45 are at their ON states and thus determines that the automatic ice production apparatus has been set to an ice removing ready state (see FIGS. 8B and 8E).

Thereafter, as the tray 42 is further turned from the ice removing ready state, the horizontal switch adjustment rib 44 mounted to the cam gear 41 is turned in such a manner that the concave portion thereof can receive the horizontal switch 43. As a result, the horizontal switch 43 is changed from its ON state to its OFF state. The lever connector 47 is still pushed by the convex portion of the ice full lever adjustment rib 46 mounted to the cam gear 41, thereby allowing the ice full lever 48 to remain at its turned state. Also, the ice full switch 45 remains at its ON state. At this time, the microcomputer 9 checks at step S8 that the horizontal switch 43 is at its OFF state and the ice full switch 45 is at its ON state and thus determines that the automatic ice production apparatus has been set to the ice removing state (see FIGS. 8C and 8F). Hence, the microcomputer 9 controls the ice removing motor rotation controller 5 at step S9 to stop the ice removing motor 4.

If the ice removing motor 4 has been over-rotated, the catch part 60 contacts the over-rotation preventing sill 62, so the cam gear 41 and the tray 42 cannot continue to rotate.

Then, at step S10, the microcomputer 9 waits for a predetermined time period until produced ice is removed from the tray 42. When the predetermined time period has elapsed, the microcomputer 9 controls the ice removing motor rotation controller 5 at step S11 to turn the tray 42 in the opposite direction to the ice removing direction. As the tray 42 is turned, the horizontal switch adjustment rib 44 mounted to the cam gear 41 is turned in such a manner that the convex portion thereof can push the horizontal switch 43 to turn it on. The lever connector 47 is still pushed by the convex portion of the ice full lever adjustment rib 46 mounted to the cam gear 41, thereby allowing the ice full lever 48 to remain at its turned state. As a result, the ice full switch 45 remains at its ON state. At this time, the microcomputer 9 checks at step S12 that the horizontal switch 43 and the ice full switch 45 are at their ON states and thus determines that the automatic ice production apparatus has been set to a returning state.

Thereafter, as the tray 42 is continuously turned, the horizontal switch 43 is positioned in the concave portion of the horizontal switch adjustment rib 44 and the lever connector 47 is positioned in the concave portion of the ice full lever adjustment rib 46. As a result, the horizontal switch 43 and the ice full switch 45 are changed from their ON states to their OFF states. At this time, the microcomputer 9 checks at step S13 that the horizontal switch 43 is at its OFF state and thus determines that the automatic ice production apparatus has been returned to its initial state (see FIGS. 8D and 8G). Hence, the microcomputer 9 controls the ice removing motor rotation controller 5 at step S14 to stop the ice removing motor 4. Noticeably, as the ice container is filled with the produced ice, the ice full lever 48 is raised, thereby causing the ice full switch 45 to be turned on. In this connection, it is preferred that, if the horizontal switch 43 is turned off, the microcomputer 9 determines regardless of the ON/OFF states of the ice full switch 45 that the tray 42 has been returned to its horizontal state.

Then, the microcomputer 9 checks at step S15 whether the automatic ice producing function has been stopped by the user. If it is checked at step S15 that the automatic ice producing function has not been stopped by the user, the microcomputer 9 increments the count by one (i.e., C=C+1) at step S16 and returns to the above step 33 to repeat it and the subsequent steps. To the contrary, in the case where it is checked at step S15 that the automatic ice producing function has been stopped by the user, the microcomputer 9 ends the entire operation.

In the case where the automatic ice producing function is continuously performed, the count is changed from an odd number to an even number and vice versa at step S4 because it is incremented by one, resulting in a change in the turning direction of the tray 42. Therefore, the tray 42 can alternately perform the normal direction ice removing operation and the reverse direction ice removing operation so that it can be prevented from being distorted or damaged.

Second, an ice removing motor protection function of the automatic ice production apparatus in accordance with the present invention will hereinafter be described in detail. In accordance with the present invention, the ice removing motor protection function is adapted to detect a load amount applied to the ice removing motor 4 and protect the ice removing motor 4 from an overload state in accordance with the detected result.

In the case where the ice removing motor 4 is rotated in the normal direction, namely, the switching transistors 14 and 17 are turned on, a drive current proportional to the drive voltage V2 from the power supply unit 1 flows to the ice removing motor 4. The drive current is converted into a voltage by the voltage detection resistor 20 and then applied to the inverting input terminal (−) of the comparator 24. Also, the drive voltage VI from the power supply unit 1 is divided at the desired ratio by the two voltage dividing resistors 22 and 23 and then applied to the non-inverting input terminal (+) of the comparator 24.

On the other hand, in the case where the ice removing motor 4 is rotated in the reverse direction, namely, the switching transistors 15 and 16 are turned on, a drive current proportional to the drive voltage V2 from the power supply unit 1 flows to the ice removing motor 4. The drive current is converted into a voltage by the voltage detection resistor 21 and then applied to the inverting input terminal (−) of the comparator 24. Also, the drive voltage V1 from the power supply unit 1 is divided at the desired ratio by the two voltage dividing resistors 22 and 23 and then applied to the non-inverting input terminal (+) of the comparator 24.

The comparator 24 compares the detected voltage at its inverting input terminal (−) with the divided voltage at its non-inverting input terminal (+) which is a reference voltage. The comparator 24 then outputs the compared result to a first input terminal IN1 of the microcomputer 9.

Provided that the ice removing motor 4 is not at an overload state, the current flowing thereto will be maintained at a desired level. In this case, the voltages detected by the voltage detection resistors 20 and 21 are lower than the reference voltage. As a result, the comparator 24 outputs a high logic control signal to the first input terminal IN1 of the microcomputer 9. In response to the high logic control signal from the comparator 24, the microcomputer 9 normally drives the ice removing motor 4 as mentioned above.

However, in the case where an overload is applied to the ice removing motor 4 because the tray 42 is distorted for a long time, the current flowing to the ice removing motor 4 rises above the desired level. In this case, the voltages detected by the voltage detection resistor 20 and 21 become higher than the reference voltage. As a result, the comparator 24 outputs a low logic control signal to the first input terminal IN1 of the microcomputer 9. In response to the high logic control signal from the comparator 24, the microcomputer 9 outputs low logic control signals at its first and second output terminals OUT1 and OUT2 to compulsorily stop the ice removing motor 4. Therefore, the ice removing motor 4 is automatically stopped at the overload state so that it can be prevented from being damaged and breaking down due to the overload.

Third, a water supply alarm/indication function of the automatic ice production apparatus in accordance with the present invention will hereinafter be described in detail. In accordance with the present invention, the water supply alarm/indication function is adapted to detect the level of water in the water supply tank and generate an alarm if the detected water level is below a predetermined value, to automatically indicate the proper time that the water supply tank is to be replenished with water.

First, a first embodiment of the water supply tank water level detection function of the automatic ice production apparatus in accordance with the present invention will hereinafter be described in detail with reference to FIG. 10. In the first embodiment, the water supply performance of the water supply motor 6 and the capacity of the water supply tank are calculated. The water supply motor 6 is adapted to supply water to the automatic ice production apparatus and the dispenser.

Figure 10:
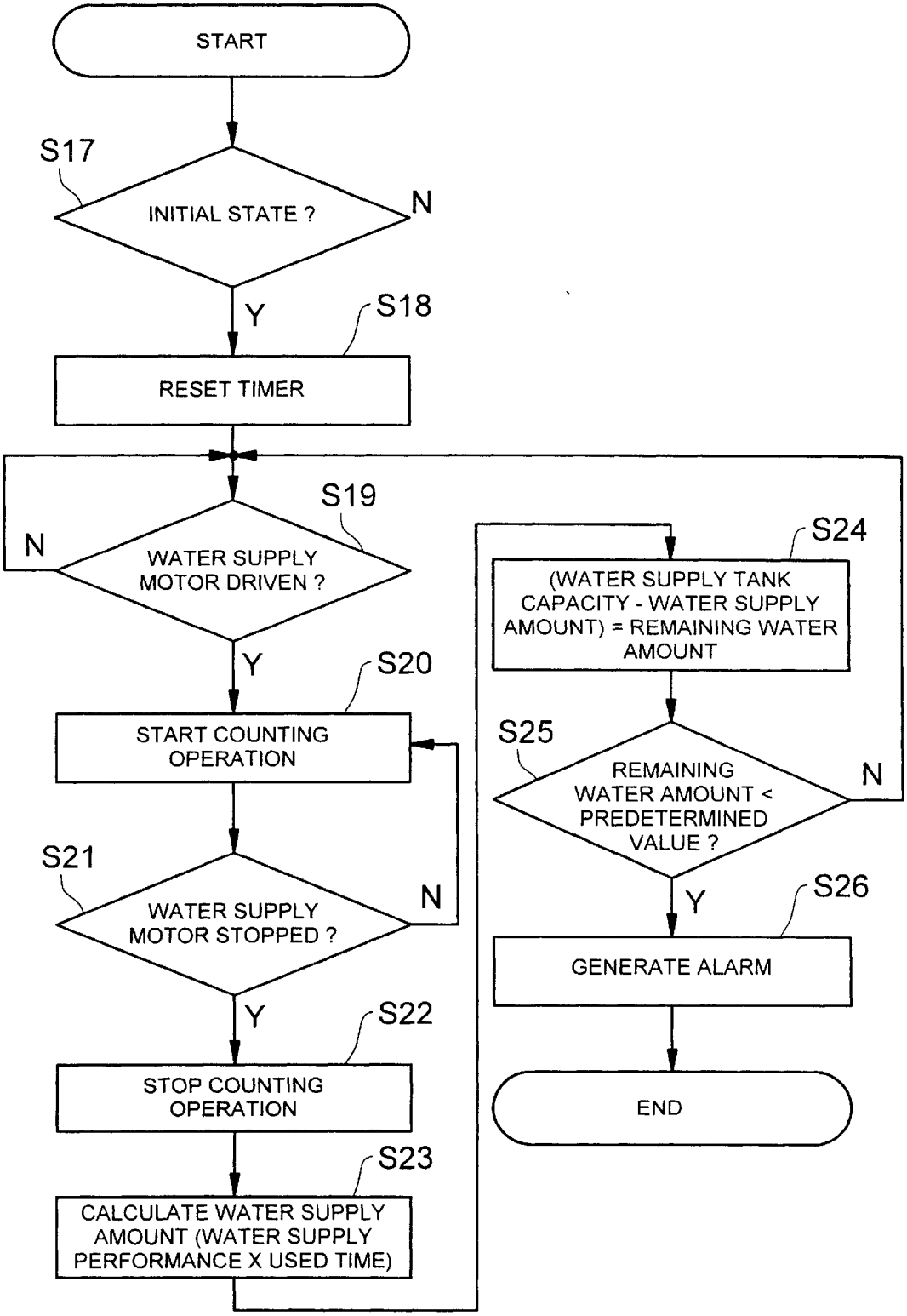
FIG. 10 is a flowchart illustrating the operation of the microcomputer in FIG. 2 which performs a first embodiment of a water supply tank water level detection function of the automatic ice production method in accordance with the present invention.

FIG. 10 is a flowchart illustrating the operation of the microcomputer 9 in FIG. 2 which performs the first embodiment of the water supply tank water level detection function of the automatic ice production apparatus in accordance with the present invention. First, the microcomputer 9 checks at step S17 whether the water level detection function has been set to its initial state. Here, the initial state of the water level detection function signifies the state that the water supply tank is filled with water by the user. If it is checked at step S17 that the water level detection function has not been set to its initial state, the microcomputer 9 returns to the above step S17 to continue to check whether the water level detection function has been set to its initial state.

In the case where it is checked at step S17 that the water level detection function has been set to its initial state, the microcomputer 9 resets a timer (not shown) at step S18 and checks at step S19 whether the water supply motor 6 has been driven.

Noticeably, the water supply motor 6 is driven when the automatic ice production apparatus or the dispenser is operated by the user. At this time, the microcomputer 9 recognizes that the water supply motor 6 has been driven. If the water supply motor 6 is driven, the microcomputer 9 outputs a control signal to the timer at step S20 to start its counting operation.

Thereafter, the microcomputer 9 checks at step S21 whether the water supply motor 6 has been stopped. If it is checked at step S21 that the water supply motor 6 has been stopped, the microcomputer 9 stops the counting operation of the timer at step S22 and calculates a water supply amount at step S23. Here, the water supply amount can be obtained by multiplying the water supply performance of the water supply motor 6 by the cumulated used time, where the water supply performance of the water supply motor 6 is a pumped water amount per second and the cumulated used time is the total time that the water supply motor 6 has been driven.

Also, the microcomputer 9 calculates the amount of water remaining in the water supply tank at step S24. Here, the amount of water remaining in the water supply tank can be obtained by subtracting the water supply amount calculated at the above step S23 from the capacity of the water supply tank.

Then, the microcomputer 9 checks at step S25 whether the remaining water amount calculated at the above step S24 is smaller than a predetermined value. If it is checked at step S25 that the remaining water amount calculated at the above step S24 is not smaller than the predetermined value, the microcomputer 9 recognizes that enough water remains in the water supply tank and thus changes its second input terminal IN2 to a high logic state. Then, the microcomputer 9 returns to the above step S19 to repeat it and the subsequent steps.

If the second input terminal IN2 of the microcomputer 9 is changed to the high logic state, no voltage difference is generated between anode and cathode terminals of the light emitting diode 35 in the alarm generator 13. As a result, the light emitting diode 35 is not driven.

On the other hand, in the case where it is checked at step S25 that the remaining water amount calculated at step S24 is smaller than the predetermined value, the microcomputer 9 recognizes that little water remains in the water supply tank and thus changes its second input terminal IN2 to a low logic state. Then, the microcomputer 9 ends the entire operation.

If the second input terminal IN2 of the microcomputer 9 is changed to the low logic state, a voltage difference is generated between the anode and cathode terminals of the light emitting diode 35 in the alarm generator 13, thereby causing the light emitting diode 35 to be driven. As a result, the user can grasp the proper time that the water supply tank is to be replenished with water.

Next, a second embodiment of the water supply tank water level detection function of the automatic ice production apparatus in accordance with the present invention will hereinafter be described in detail with reference to FIG. 11. In the second embodiment, the ice removing sensor 49 mounted to the ice removing discriminator 8 is used to sense a temperature variation of the tray 42.

Figure 11:
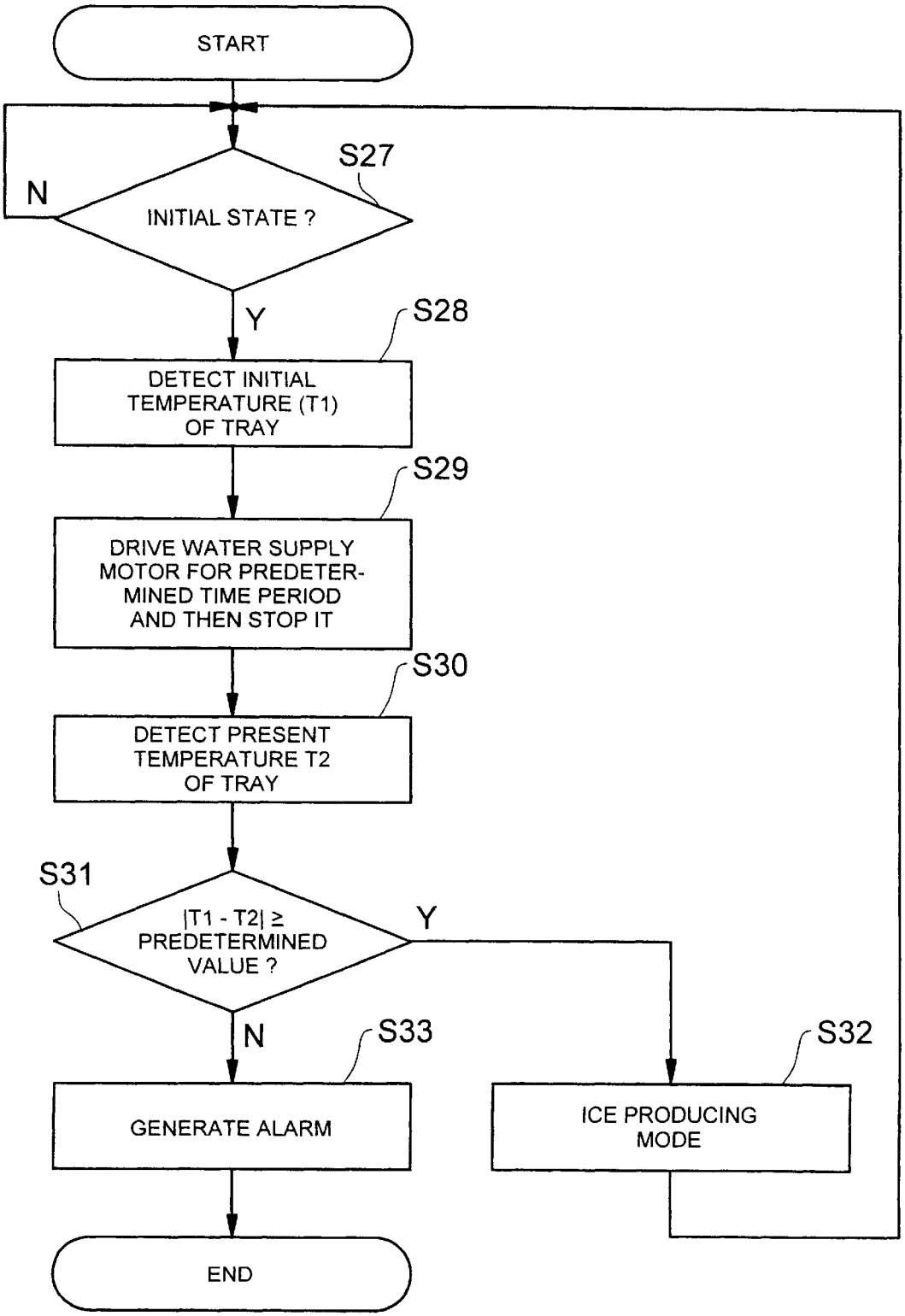
FIG. 11 is a flowchart illustrating the operation of the microcomputer in FIG. 2 which performs a second embodiment of the water supply tank water level detection function of the automatic ice production method in accordance with the present invention.

FIG. 11 is a flowchart illustrating the operation of the microcomputer 9 in FIG. 2 which performs the second embodiment of the water supply tank water level detection function of the automatic ice production apparatus in accordance with the present invention. Generally, the temperature of a fresh food compartment of a refrigerator is maintained within the range of about 3° C. to 7° C. above zero and the temperature of a freezer compartment of the refrigerator is maintained within the range of about 12° C. to 20° C. below zero. In this connection, for the convenience of description, the reference temperature of the fresh food compartment is set to 4° C. above zero and the reference temperature of the freezer compartment is set to 18° C. below zero.

First, the microcomputer 9 checks at step S27 whether the automatic ice production apparatus has been set to its initial state after completing the ice removing operation. Here, the initial state of the automatic ice production apparatus signifies that the tray 42 has been returned to its horizontal state. If it is checked at step S27 that the automatic ice production apparatus has not been set to its initial state, the microcomputer 9 returns to the above step S27 to continue to check whether the automatic ice production apparatus has been set to its initial state.

In the case where it is checked at step S27 that the automatic ice production apparatus has been set to its initial state, the microcomputer 9 outputs a control signal to the ice removing discriminator 8 at step S28 to detect the initial temperature T1 of the tray 42 from the ice removing sensor 49. Because the reference temperature of the freezer compartment was initially set to 18° C. below zero, the initial temperature T1 of the tray 42 is 18° C. below zero under the condition that no water is supplied to the tray 42.

The microcomputer 9 outputs a control signal to the water supply motor rotation controller 7 at step S29 to drive the water supply motor 6 for a predetermined time period and then to stop it. The construction and operation of the water supply motor rotation controller 7 are the same as those of the ice removing motor rotation controller 5 and a description thereof will thus be omitted.

If the water supply motor 6 is stopped, the microcomputer 9 outputs a control signal to the ice removing discriminator 8 at step S30 to detect the present temperature T2 of the tray 42 from the ice removing sensor 49. Because the reference temperature of the fresh food compartment was initially set to 4° C. above zero, the temperature of water stored in the water supply tank is maintained at 4° C. above zero. As a result, under the condition that the water supply to the tray 42 is completed, the present temperature T2 of the tray 42 rises rapidly from 18° C. below zero to be within the range of 4° C. above zero to 18° C. below zero.

At step S31, the microcomputer 9 calculates a difference |T1−T2| between the initial and present temperatures T1 and T2 of the tray 42 and checks whether the calculated temperature difference |T1−T2| is greater than or equal to a predetermined value. If it is checked at step S31 that the calculated temperature difference |T1−T2| is greater than or equal to the predetermined value, the microcomputer 9 recognizes that the water supply to the tray 42 is normal and thus controls the automatic ice production apparatus at step S32 to perform the ice producing mode. Then, the microcomputer 9 returns to the above step S27 to repeat it and the subsequent steps.

On the other hand, in the case where it is checked at step S31 that the calculated temperature difference |T1−T2| is smaller than the predetermined value, the microcomputer 9 recognizes that no water is supplied to the tray 42 and little water remains in the water supply tank and thus changes its second input terminal IN2 to the low logic state at step S33 to allow the alarm generator 13 to generate the alarm. Then, the microcomputer 9 ends the entire operation.

If the second input terminal IN2 of the microcomputer 9 is changed to the low logic state, a voltage difference is generated between the anode and cathode terminals of the light emitting diode 35 in the alarm generator 13, thereby causing the light emitting diode 35 to be driven. As a result, the user can determine whether the water supply tank is to be replenished with water.

Now, a third embodiment of the water supply tank water level detection function of the automatic ice production apparatus in accordance with the present invention will hereinafter be described in detail with reference to FIGS. 12A to 13. In the third embodiment, a water level sensor 51 is mounted to a water supply tank 50 to sense the level of water therein.

Figure 12A:
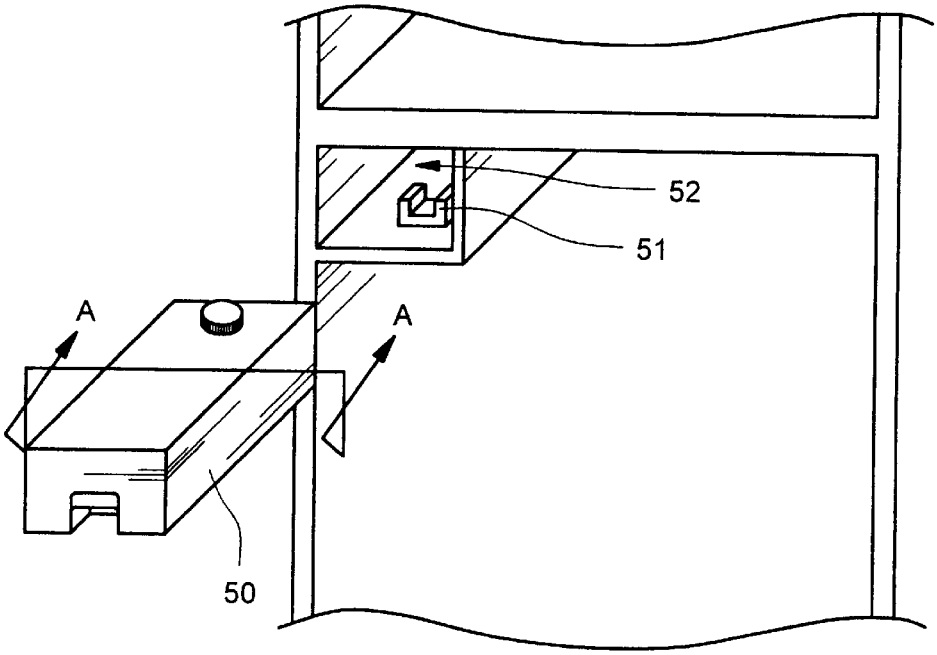
FIGS. 12A and 12B are partial perspective views illustrating an arrangement for performing a third embodiment of the water supply tank water level detection function of the automatic ice production apparatus in accordance with the present invention.
Figure 12B:
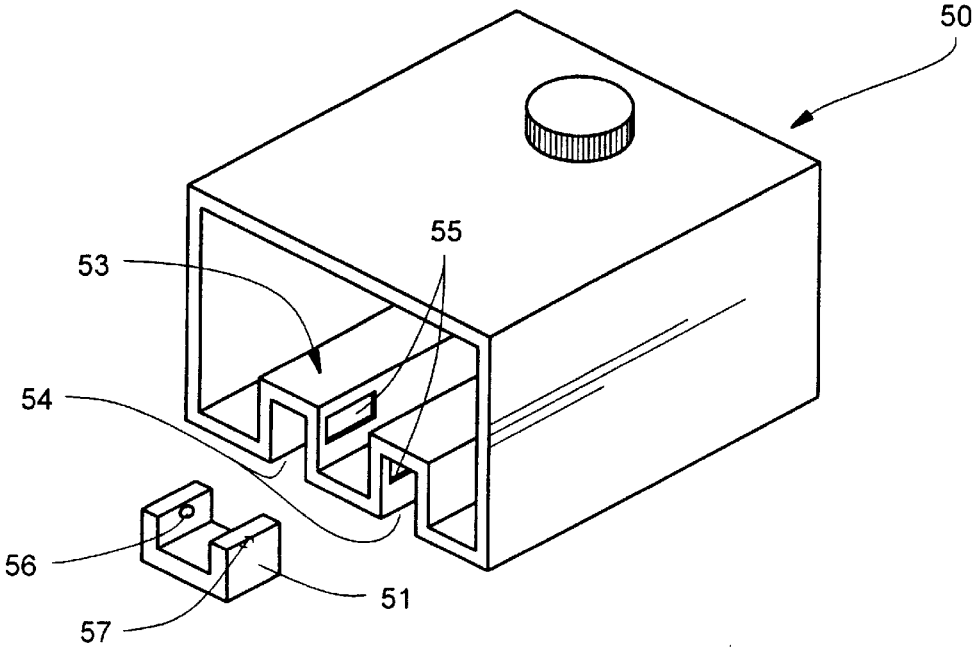

FIGS. 12A and 12B are partial perspective views illustrating an arrangement for performing the third embodiment of the water supply tank water level detection function of the automatic ice production apparatus in accordance with the present invention.

As shown in FIG. 12A, a chamber 52 is defined in a given position inside the fresh food compartment and receives the water supply tank 50 therein. In this case, the water supply tank 50 is movably received in the chamber 52 in a way such that the tank 50 can be removed from the chamber 52 as desired.

The water level sensor 51 is fixedly mounted to the bottom center of the chamber 52. The above sensor 51 is axially grooved and thereby forms an axial channel sided by opposite side walls. The sensor 51 thus has a generally U-shaped cross-section. In order to allow the tank 50 to smoothly slide inside the chamber 52 having the above sensor 51, the bottom of the water supply tank 50 is pressed to form sensor receiving means 53 as shown in FIG. 12B. The above sensor receiving means 53 has a configuration suitable for receiving the side walls of the sensor 51. Since the bottom of the tank 50 has the configuration matching with the sensor 51 of the U-shaped cross-section as described above, the tank 50 can smoothly slide in the chamber 52 while moving in the chamber 52.

The above sensor receiving means 53 comprises a pair of parallel grooves 54 which axially extend on the bottom of the tank 50 and slidably receive the side walls of the sensor 51, respectively. The opposite side walls of the above grooves 54 are provided with transparent windows 55 capable of passing light.

A photocoupler is also disposed in the water level sensor 51. The photocoupler includes a photodiode 56 and a phototransistor 57 provided respectively at the opposite side walls of the water level sensor 51. The photodiode 56 is adapted to generate an optical signal and the phototransistor 57 is adapted to receive the optical signal from the photodiode 56.

When the chamber 52 receives the water supply tank 50, the side walls of the water level sensor 51 are received by the sensor receiving means 53 of the water supply tank 50. Under this condition, the optical signal from the photodiode 56 mounted to the water level sensor 51 is received by the phototransistor 57 mounted to the water level sensor 51 through the transparent windows 55 provided at the grooves 54.

Figure 13:
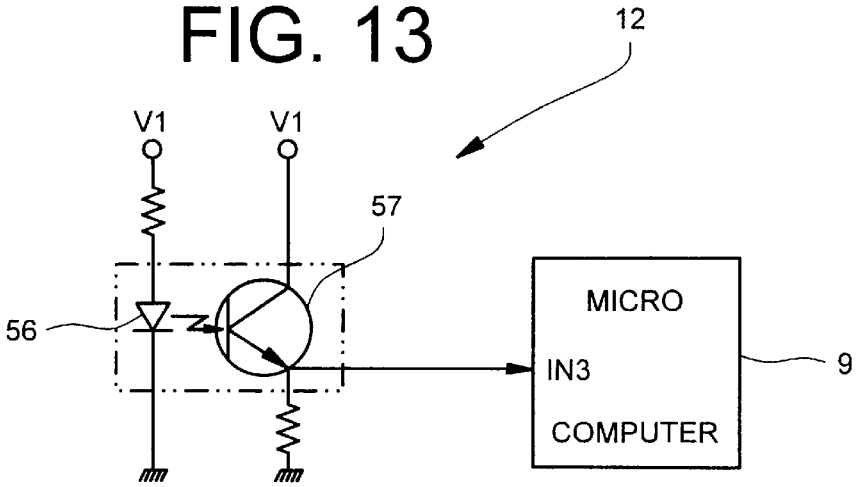
FIG. 13 is a detailed circuit diagram of a water level sensor in FIGS. 12A and 12B.

FIG. 13 is a detailed circuit diagram of the water level sensor 51 in FIGS. 12A and 12B. As shown in this drawing, the drive voltage V1 from the power supply unit 1 is applied to the photodiode 56 which then generates the optical signal. The phototransistor 57 is switched in response to the optical signal from the photodiode 56 to control the supply of the drive voltage V1 from the power supply unit 1 to a third input terminal IN3 of the microcomputer 9.

In operation, when the amount of water remaining in the water supply tank 50 is above a predetermined value, the optical signal from the photodiode 56 in the water level sensor 51 is transmitted through the transparent windows 55 in the water supply tank 55 but diffusely reflected by the water in the water supply tank 50. As a result, the optical signal from the photodiode 56 in the water level sensor 51 does not arrive at the phototransistor 57 in the water supply sensor 51. Because the phototransistor 57 does not receive the optical signal from the photodiode 56, it remains at its OFF state. The drive voltage V1 from the power supply unit 1 is not supplied but interrupted to the third input terminal IN3 of the microcomputer 9 due to the OFF state of the phototransistor 57. Therefore, the third input terminal IN3 of the microcomputer 9 remains at its low logic state.

Then, the microcomputer 9 changes its second input terminal IN2 to the high logic state to allow the alarm generator 13 to generate no alarm.

On the other hand, in the case where the amount of water remaining in the water supply tank 50 is below the predetermined value, namely, little water remains in the water supply tank 50, the optical signal from the photodiode 56 in the water level sensor 51 is transmitted to the phototransistor 57 therein through the transparent windows 55 in the water supply tank 55. Because the phototransistor 57 receives the optical signal from the photodiode 56, it is turned on. As a result, the drive voltage V1 from the power supply unit 1 is supplied to the third input terminal IN3 of the microcomputer 9 through the turned-on phototransistor 57, thereby causing the third input terminal IN3 to be changed to its high logic state.

In response to the high logic state of the third input terminal IN3, the microcomputer 9 recognizes that little water remains in the water supply tank 50 and thus changes its second input terminal IN2 to the low logic state. As a result, the alarm generator 13 is driven as mentioned above with reference to FIG. 6, so that the user can grasp the proper time that the water supply tank 50 is to be replenished with water.

Noticeably, the alarm generator 13 may include any visually displayable device instead of the light emitting diode 35. Alternatively, the alarm generator 13 may include a sound generation device for generating a sound signal, such as a buzzer.

Fourth, a water supply state control function of the automatic ice production apparatus in accordance with the present invention will hereinafter be described in detail with reference to FIGS. 5 and 14. In accordance with the present invention, the water supply state control function is adapted to stop the operation of the automatic ice production apparatus and preferentially supply water to the dispenser, when the automatic ice production apparatus is driven simultaneously with the dispenser.

Figure 14:
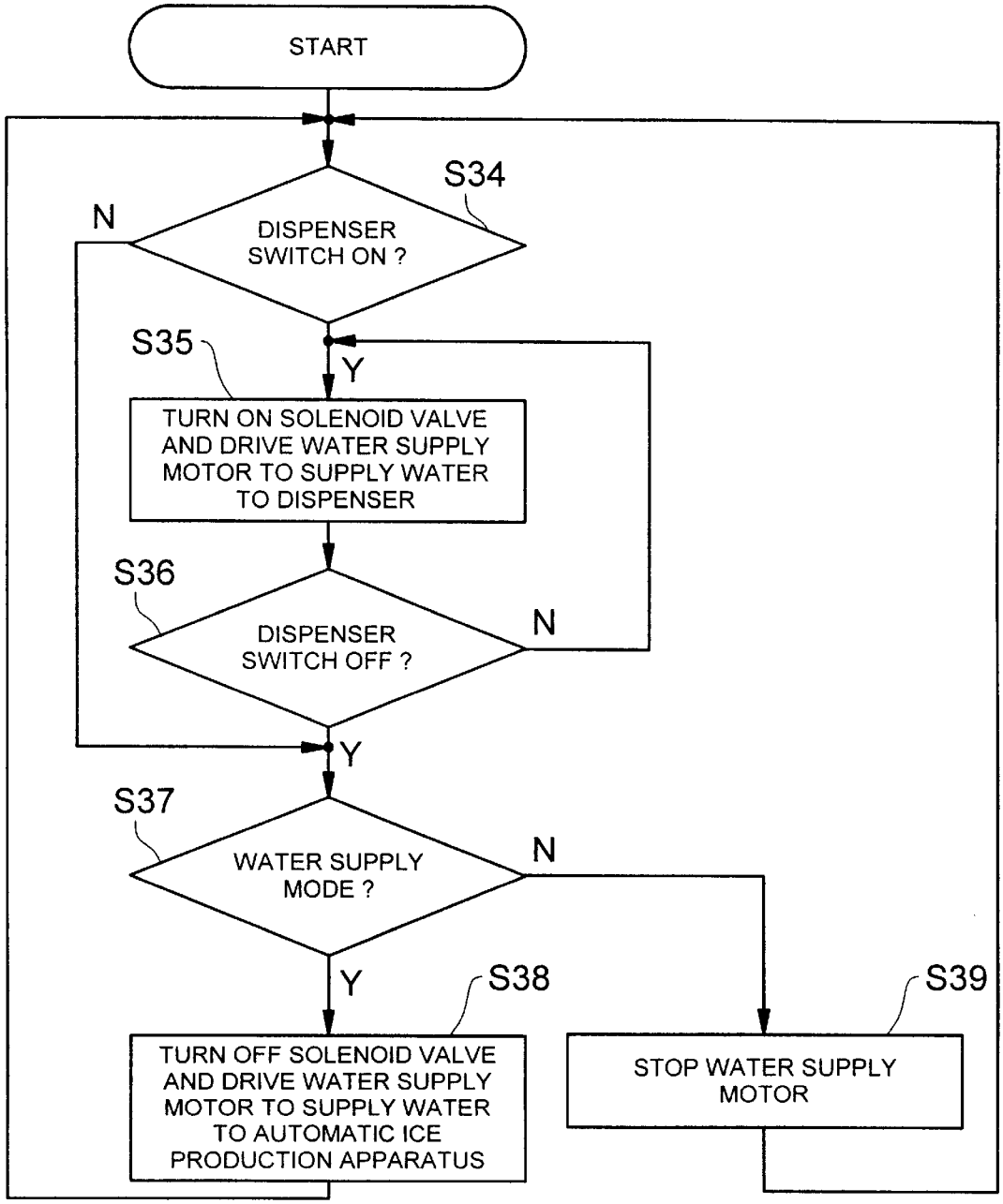
FIG. 14 is a flowchart illustrating the operation of the microcomputer in FIG. 2 which performs a water supply state control function of the automatic ice production method in accordance with the present invention.

FIG. 14 is a flowchart illustrating the operation of the microcomputer 9 in FIG. 2 which performs the water supply state control function of the automatic ice production apparatus in accordance with the present invention. First, the microcomputer 9 checks at step S34 whether the dispenser switch 31 is at its ON state. The user turns on the dispenser switch 31 to use the dispenser. At this time, the microcomputer 9 senses the ON state of the dispenser switch 31 and thus outputs a high logic control signal at its fifth output terminal OUT5. The high logic control signal from the fifth output terminal OUT5 of the microcomputer 9 is applied to a base terminal of the control transistor 34, thereby causing the control transistor 34 to be turned on. As the control transistor 34 is turned on, it transfers the drive voltage V1 from the power supply unit 1 to a base terminal of the switching transistor 33 to turn on the switching transistor 33. When the switching transistor 33 is turned on, the solenoid valve 32 receives the drive voltage V2 from the power supply unit 1 at its one terminal and the ground voltage at its other terminal. As a result, the solenoid valve 32 is turned on to close a water path to the automatic ice production apparatus whereas to open a water path to the dispenser. Also, the microcomputer 9 outputs a control signal to the water supply motor rotation controller 7 to drive the water supply motor 6. As the water supply motor 6 is driven, it pumps water from the water supply tank and supplies the pumped water to the dispenser (step S35).

Thereafter, the microcomputer 9 checks at step S36 whether the dispenser switch 31 has been turned off. If it is checked at step 336 that the dispenser switch 31 has not been turned off, the microcomputer 9 returns to the above step S35 to control the solenoid valve 32 and the water supply motor 6 to continuously perform the water supply to the dispenser.

On the other hand, in the case where it is checked at step S36 that the dispenser switch 31 has been turned off, the microcomputer 9 checks at step S37 whether the automatic ice production apparatus has been changed to a water supply mode. If it is checked at step S37 that the automatic ice production apparatus has been changed to the water supply mode, the microcomputer 9 outputs a low logic control signal at its fifth output terminal OUT5. The low logic control signal from the fifth output terminal OUT5 of the microcomputer 9 is applied to the base terminal of the control transistor 34, thereby causing the control transistor 34 to be turned off. As the control transistor 34 is turned off, it interrupts the drive voltage V1 from the power supply unit 1 to the base terminal of the switching transistor 33 to turn off the switching transistor 33. When the switching transistor 33 is turned off, the solenoid valve 32 does not conduct. As a result, the solenoid valve 32 is turned off to open the water path to the automatic ice production apparatus whereas to close the water path to the dispenser. Also, the microcomputer 9 outputs a control signal to the water supply motor rotation controller 7 to drive the water supply motor 6. As the water supply motor 6 is driven, it pumps water from the water supply tank and supplies the pumped water to the automatic ice production apparatus (step S38). Then, the microcomputer 9 returns to the above step S34 to repeat it and the subsequent steps.

In the case where it is checked at step S37 that the automatic ice production apparatus has not been changed to the water supply mode, the microcomputer 9 stops the water supply motor 6 at step S39 and returns to the above step S34 to repeat it and the subsequent steps.

On the other hand, if it is checked at step S34 that the dispenser switch 31 is at its OFF state, the microcomputer 9 proceeds directly to the above step S37 to repeat it and the subsequent steps.

Therefore, when the automatic ice production apparatus and the dispenser are simultaneously changed to the water supply mode, the dispenser is preferentially driven.

Last, a water supply motor control function of the automatic ice production apparatus in accordance with the present invention will hereinafter be described in detail with reference to FIG. 4. In accordance with the present invention, the water supply motor control function is adapted to prevent the freezing of the remaining water in a water supply hose to the automatic ice production apparatus by rotating the water supply motor 6 in the reverse direction to feed the remaining water in the water supply hose back to the water supply tank.

First, the microcomputer 9 outputs a low logic control signal at its third output terminal OUT3 and a high logic control signal at its fourth output terminal OUT4. In the water supply motor rotation controller 7, the control transistor 29 inputs the low logic control signal from the third output terminal OUT3 of the microcomputer 9 at its base terminal and the control transistor 30 inputs the high logic control signal from the fourth output terminal OUT4 of the microcomputer 9 at its base terminal. Preferably, the control transistors 29 and 30 are of the NPN type. As a result, the control transistor 29 is turned off in response to the low logic control signal from the third output terminal OUT3 of the microcomputer 9 and the control transistor 30 is turned on in response to the high logic control signal from the fourth output terminal OUT4 of the microcomputer 9. As the control transistor 29 is turned off, the switching transistors 26 and 27 are turned off.

As the control transistor 30 is turned on, it transfers the drive voltage V1 from the power supply unit 1 to a base terminal of the switching transistor 28, thereby causing the switching transistor 28 to be turned on. As the switching transistor 28 is turned on, the ground voltage is transferred to a collector terminal of the switching transistor 28 and a low logic signal is thus applied to a base terminal of the switching transistor 25. Preferably, the switching transistor 25 is of the PNP type. As a result, the switching transistor 25 is turned on in response to the low logic signal. The turning-on of the switching transistor 25 forms a loop of power supply unit 1 switching transistor 25 water supply motor 6 switching transistor 28 ground terminal. With the loop formed, the drive voltage V2 from the power supply unit 1 is supplied to the water supply motor 6 to rotate it clockwise.

As the water supply motor 6 is clockwise rotated by the above operation of the water supply motor rotation controller 7, it pumps water from the water supply tank 50 for a predetermined time period to supply the pumped water to the tray 42 in the automatic ice production apparatus.

At this time, water remains in the water supply hose because it failed to be supplied from the water supply tank 50 to the tray 42 in the automatic ice production apparatus. The remaining water in the water supply hose may freeze due to the very low temperature of the freezer compartment. In this case, water from the water supply tank 50 is not normally supplied to the tray 42 in the automatic ice production apparatus, resulting in a faulty operation of the automatic ice production apparatus. In order to overcome such a problem the remaining water in the water supply hose must be fed back to the water supply tank 50.

Therefore, after the lapse of the predetermined time period that water from the water supply tank 50 is supplied to the tray 42 in the automatic ice production apparatus, the microcomputer 9 outputs a high logic control signal at its third output terminal OUT3 and a low logic control signal at its fourth output terminal OUT4. The high logic control signal from the third output terminal OUT3 of the microcomputer 9 is applied to the base terminal of the control transistor 29 and the low logic control signal from the fourth output terminal OUT4 of the microcomputer 9 is applied to the base terminal of the control transistor 30. Because the control transistors 29 and 30 are of the NPN type, the control transistor 29 is turned on in response to the high logic control signal from the third output terminal OUT3 of the microcomputer 9 and the control transistor 30 is turned off in response to the low logic control signal from the fourth output terminal OUT4 of the microcomputer 9. As the control transistor 30 is turned off, the switching transistors 25 and 28 are turned off.

As the control transistor 29 is turned on, it transfers the drive voltage V1 from the power supply unit 1 to a base terminal of the switching transistor 28, thereby causing the switching transistor 28 to be turned on. As the switching transistor 28 is turned on, the ground voltage is transferred to a collector terminal of the switching transistor 26 and a low logic signal is thus applied to a base terminal of the switching transistor 27. Preferably, the switching transistor 27 is of the PNP type. As a result, the switching transistor 27 is turned on in response to the low logic signal. The turning-on of the switching transistor 27 forms a loop of power supply unit 1 switching transistor 27 water supply motor 6 switching transistor 26 ground terminal. With the loop formed, the drive voltage V2 from the power supply unit 1 is supplied to the water supply motor 6 to rotate the water supply motor 6 counterclockwise.

As the water supply motor 6 is counterclockwise rotated by the above operation of the water supply motor rotation controller 7, it feeds the remaining water in the water supply hose back to the water supply tank 50.

Thereafter, the microcomputer 9 outputs low logic control signals at its third and fourth output terminals OUT3 and OUT4 to stop the water supply motor 6.

Therefore, the remaining water in the water supply hose can be prevented from freezing.

As apparent from the above description, the present invention has the following advantages.

First, the tray alternately performs the normal direction ice removing operation and the reverse direction ice removing operation so that it can be prevented from being distorted or damaged. Therefore, the tray life can be increased.

Second, when an overload is applied to the ice removing motor while the ice removing operation is performed, it is automatically detected, thereby causing the ice removing motor to be stopped Therefore, the ice removing motor life can be increased and breakdown can be prevented.

Third, when the level of water in the water supply tank is below the predetermined value, the alarm is automatically generated so that the user can readily determine when the water supply tank is to be replenished with water.

Fourth, when the automatic ice production function and the dispenser are simultaneously provided in a refrigerator, the operation of the automatic ice production apparatus is stopped and water is preferentially supplied to the dispenser. Therefore, the user does not have to operate the dispenser for a long time to obtain a desired amount of water therefrom.

Last, the remaining water in the water supply hose to the tray is fed back to the water supply tank. Therefore, the remaining water in the water supply hose can be prevented from freezing. This has the effect of stabilizing the water supply function and thus preventing a faulty operation thereof.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An automatic ice production method, comprising the steps of:

alternatively performing a normal direction ice removing operation and a reverse direction ice removing operation of an ice removing motor;

controlling the operation of said ice removing motor in response to a signal from an overload state;

detecting the level of water in said water supply tank and, if the detected water level is below a predetermined value, generating an alarm;

stopping said automatic ice production function and preferentially supplying water to a water dispenser when automatic ice production and water dispensing are simultaneously enabled; and feeding water remaining in a water supply hose back to said water supply tank following a refill of an automatic ice tray.

2. An automatic ice production method as set forth in claim 1, wherein said ice removing motor protection step includes the step of, if the control signal from said ice removing motor protection means is a normal state signal, turning on said ice removing motor rotation control means to normally drive said ice removing motor and, if the control signal from said ice removing motor protection means is an overload state signal, turning off said ice removing motor rotation control means to stop the operation of said ice removing motor.

3. An automatic ice production method as set forth in claim 1, wherein said water supply alarm/indication step includes the step of calculating the capacity of said water supply tank, ascertaining a water supply amount, calculating a difference between the calculated capacity of said water supply tank and the ascertained water supply amount to obtain the amount of water remaining in said water supply tank and, if the obtained water amount is below a predetermined value, generating the alarm.

4. An automatic ice production method as set forth in claim 3, wherein the ascertaining of the water supply amount is performed by multiplying a water supply performance of said water supply motor by a time used, where the water supply performance of said water supply motor is a pumped water amount per second.

5. An automatic ice production method as set forth in claim 3, wherein said water supply alarm/indication step includes the steps of:

initializing a counting operating if said water supply alarm/indication mode is in an initial state in which said water supply tank is filled with water by the user;

counting spent time while driving said water supply motor;

calculating the total water supply amount by said counted spent time and a water supply performance of said water supply motor when said water supply motor is stopped;

calculating the difference between the capacity of said water supply tank and the calculated total water supply amount to obtain the amount of water remaining in said water supply tank; and generating an alarm if the water amount calculated above is below the predetermined value.

6. An automatic ice production method as set forth in claim 1, wherein said water supply alarm/indication step includes the step of detecting an initial temperature of said tray after the ice removing operation is completed, detecting a present temperature of said tray after water is supplied to said tray, calculating a difference between the detected initial and present temperatures of said tray and, if the calculated difference is below a predetermined value, generating an alarm.

7. An automatic ice production method as set forth in claim 6, wherein said calculation of the total water supply amount includes the steps of:

detecting the initial temperature of said tray at the initial state where the ice removing operation is completed;

detecting the present temperature of said tray after the ice removing operation is completed, and water is supplied to said tray; and calculating the difference between the detected initial and present temperatures of said tray and, if the calculated difference is below the predetermined value, generating the alarm.

8. An automatic ice production method as set forth in claim 1, wherein said water supply state control step includes the steps of:

checking whether a dispenser switch disposed at a desired position outside a refrigerator has been turned on by a user;

supplying water to said dispenser if it is determined that said dispenser switch has been turned on by the user;

checking whether said automatic ice production is in a water supply mode when said dispenser switch is turned off; and supplying water to said tray if it is determined that said automatic ice production is in the water supply mode.

9. An automatic ice production method as set forth in claim 1, wherein said water supply motor control step includes the steps of supplying water to said tray if said automatic ice production is in a water supply mode and then rotating said water supply motor in the reverse direction for a predetermined time period.

* * * * *